US010189037B2

(12) United States Patent
Schmon et al.

(10) Patent No.: US 10,189,037 B2
(45) Date of Patent: Jan. 29, 2019

(54) EASY-TO-CLEAN SPRAY GUN, ACCESSORIES THEREFOR, AND MOUNTING AND DISMOUNTING METHODS

(75) Inventors: Ewald Schmon, Granfenberg (DE); Peter Dettlaff, Remseck (DE); Jens Brose, Ottmarsheim (DE)

(73) Assignee: SATA GMBH & CO. KG, Kornwestheim (DE)

( * ) Notice: Subject to any disclaimer, the term of this patent is extended or adjusted under 35 U.S.C. 154(b) by 0 days.

(21) Appl. No.: 14/113,649

(22) PCT Filed: May 5, 2012

(86) PCT No.: PCT/EP2012/001939
§ 371 (c)(1),
(2), (4) Date: Oct. 24, 2013

(87) PCT Pub. No.: WO2013/000524
PCT Pub. Date: Jan. 3, 2013

(65) Prior Publication Data

US 2014/0048627 A1 Feb. 20, 2014

(30) Foreign Application Priority Data

Jun. 30, 2011 (DE) ..... 10 2011 106 060

(51) Int. Cl.
*B05B 9/01* (2006.01)
*B05B 1/30* (2006.01)
(Continued)

(52) U.S. Cl.
CPC ..... *B05B 9/01* (2013.01); *B05B 1/3046* (2013.01); *B05B 7/2408* (2013.01);
(Continued)

(58) Field of Classification Search
CPC ..... B05B 1/3046; B05B 7/2478; B05B 9/01; B05B 7/064; B05B 7/066; B05B 7/247;
(Continued)

(56) References Cited

U.S. PATENT DOCUMENTS 40,433 A 10/1863 Sees
327,260 A 9/1885 Hart
(Continued)

FOREIGN PATENT DOCUMENTS

AT 153883 6/1997
AT 163577 3/1998
(Continued)

OTHER PUBLICATIONS

International Search Report dated Jan. 1, 2013 for International Application PCT/EP2012/001939 with English translation.
(Continued)

*Primary Examiner* — Alexander Valvis
*Assistant Examiner* — Cody Lieuwen
(74) *Attorney, Agent, or Firm* — Paul D. Bianco; Katharine Davis; Fleit Gibbons Gutman Bongini & Bianco PL

(57) ABSTRACT

A spray gun includes a one-piece main body, a trigger, a paint needle operating element coupled to the trigger, a paint needle coupled to the paint needle operating element, and an exchangeable spray agent guiding unit, the inlet region of which is or can be connected to a material supply device for the material to be sprayed, wherein the main body has at least one opening for receiving the exchangeable spray agent directing unit. Also disclosed is a material supply device, a cover, a method for mounting an exchangeable spray agent guiding unit in or on a spray gun having a one-piece main body, and a method for removing an exchangeable spray agent directing unit from or out of a one-piece spray gun.

24 Claims, 8 Drawing Sheets

(51) Int. Cl.

| | |
|---|---|
| ***B05B 7/24*** | (2006.01) |
| ***B05B 7/06*** | (2006.01) |
| ***B05B 7/08*** | (2006.01) |
| ***B05B 7/12*** | (2006.01) |

(52) U.S. Cl.
CPC ..... *B05B 7/2435* (2013.01); *B05B 7/2478* (2013.01); *B05B 7/066* (2013.01); *B05B 7/0815* (2013.01); *B05B 7/1218* (2013.01); *Y10T 29/494* (2015.01)

(58) Field of Classification Search
CPC ... B05B 7/2408; B05B 7/2435; B05B 7/0815; B05B 7/1218; B05B 7/1209; B05B 15/065; Y10T 29/494
USPC ..... 239/252, 398, 407, 408, 526, 569, 579, 239/600, DIG. 14, 290, 291
See application file for complete search history.

(56) References Cited

U.S. PATENT DOCUMENTS

| | | | |
|---|---|---|---|
| 459,432 | A | 9/1891 | Anderson |
| 459,433 | A | 9/1891 | Avery |
| 548,816 | A | 10/1895 | Paul |
| 552,213 | A | 12/1895 | Troy |
| 552,715 | A | 1/1896 | Lugrin |
| 563,505 | A | 7/1896 | McCornack |
| 581,107 | A | 4/1897 | Emery |
| 644,803 | A | 3/1900 | Justi |
| 672,012 | A | 4/1901 | Ruper |
| 574,880 | A | 5/1901 | Schmidt et al. |
| 1,662,496 | A | 3/1928 | Forsgard |
| 1,703,383 | A | 2/1929 | Birkenmaier |
| 1,703,384 | A | 2/1929 | Birkenmaier |
| 1,711,221 | A | 4/1929 | Blakeslee |
| 1,751,787 | A | 3/1930 | Binks |
| 1,889,201 | A | 11/1932 | Holveck |
| 2,008,381 | A | 7/1935 | Beeg |
| 2,049,700 | A | 8/1936 | Gustafson |
| 2,051,210 | A | 8/1936 | Gustafsson |
| 2,070,696 | A | 2/1937 | Tracy |
| 2,116,036 | A | 5/1938 | Money |
| 2,125,445 | A | 8/1938 | Holveck |
| 2,198,441 | A | 4/1940 | Lobegott |
| 2,204,599 | A | 6/1940 | Jenkins |
| 2,269,057 | A | 1/1942 | Jenkins |
| D133,223 | S | 7/1942 | Tammen |
| 2,356,865 | A | 8/1944 | Mason |
| 2,416,856 | A | 3/1947 | Thomsen |
| 2,416,923 | A | 3/1947 | Jenkins |
| 2,557,593 | A | 6/1951 | Bjorkman |
| 2,557,606 | A | 6/1951 | Liedberg |
| 2,559,091 | A | 7/1951 | Reasenberg |
| 2,609,961 | A | 9/1952 | Sapien |
| 2,612,899 | A | 10/1952 | Webb |
| 2,646,314 | A | 7/1953 | Peeps |
| 2,721,004 | A | 10/1955 | Schultz |
| 2,844,267 | A | 7/1958 | Petriccione |
| 2,886,252 | A | 5/1959 | Ehrensperger |
| 3,090,530 | A | 5/1963 | Peeps |
| D196,477 | S | 10/1963 | Kelly |
| 3,159,472 | A | 12/1964 | Revell |
| D200,594 | S | 3/1965 | Sass |
| 3,240,398 | A | 3/1966 | Dalton, Jr. |
| D204,306 | S | 4/1966 | Hamm |
| D205,760 | S | 9/1966 | Hocutt et al. |
| D208,903 | S | 10/1967 | Zadron et al. |
| 3,344,992 | A | 10/1967 | Norris |
| 3,381,845 | A | 5/1968 | MacDonald |
| 3,417,650 | A | 12/1968 | Varrin |
| 3,420,106 | A | 1/1969 | Keller et al. |
| 3,435,683 | A | 4/1969 | Keller et al. |
| 3,482,781 | A | 12/1969 | Sharpe |
| D217,928 | S | 6/1970 | Felske |
| 3,524,589 | A | 8/1970 | Pelton, Jr. |
| 3,527,372 | A | 9/1970 | Manning |
| 3,583,632 | A | 6/1971 | Schaffer |
| 3,622,078 | A | 11/1971 | Gronert |
| 3,645,562 | A | 2/1972 | Fandetti et al. |
| 3,656,493 | A | 4/1972 | Black et al. |
| 3,714,967 | A | 2/1973 | Zupan et al. |
| 3,746,253 | A | 7/1973 | Walberg |
| 3,747,850 | A | 7/1973 | Hastings et al. |
| 3,771,539 | A | 11/1973 | De Santis |
| 3,840,143 | A | 10/1974 | Davis et al. |
| 3,848,807 | A | 11/1974 | Partida |
| 3,857,511 | A | 12/1974 | Govindan |
| 3,870,223 | A | 3/1975 | Wyant |
| 3,873,023 | A | 3/1975 | Moss et al. |
| 4,000,915 | A | 1/1977 | Strom |
| D245,048 | S | 7/1977 | Pool |
| D252,097 | S | 6/1979 | Probst et al. |
| 4,160,525 | A | 7/1979 | Wagner |
| 4,171,091 | A | 10/1979 | van Hardeveld et al. |
| 4,210,263 | A | 7/1980 | Bos |
| 4,273,293 | A | 6/1981 | Hastings |
| 4,411,387 | A | 10/1983 | Stern et al. |
| 4,478,370 | A | 10/1984 | Hastings |
| D276,472 | S | 11/1984 | Harrison |
| D278,543 | S | 4/1985 | Gintz |
| 4,545,536 | A | 10/1985 | Avidon |
| 4,562,965 | A | 1/1986 | Ihmels et al. |
| 4,580,035 | A | 4/1986 | Luscher |
| 4,585,168 | A | 4/1986 | Even et al. |
| 4,614,300 | A | 9/1986 | Falcoff |
| 4,643,330 | A | 2/1987 | Kennedy |
| 4,653,661 | A | 3/1987 | Buchner et al. |
| 4,667,878 | A | 5/1987 | Behr |
| 4,713,257 | A | 12/1987 | Luttermoeller |
| D293,950 | S | 1/1988 | Ogden et al. |
| 4,730,753 | A | 3/1988 | Grime |
| 4,767,057 | A | 8/1988 | Degli et al. |
| D298,372 | S | 11/1988 | Taylor, Jr. |
| 4,784,184 | A | 11/1988 | Gates |
| 4,806,736 | A | 2/1989 | Schirico |
| 4,826,539 | A | 5/1989 | Harpold |
| 4,832,232 | A | 5/1989 | Broccoli |
| 4,863,781 | A | 9/1989 | Kronzer |
| 4,877,144 | A | 10/1989 | Thanisch |
| D305,057 | S | 12/1989 | Morgan |
| 4,887,747 | A | 12/1989 | Ostrowsky et al. |
| 4,901,761 | A | 2/1990 | Taylor |
| 4,906,151 | A | 3/1990 | Kubis |
| 4,917,300 | A | 4/1990 | Gloviak et al. |
| 4,946,075 | A | 8/1990 | Lundback |
| 4,964,361 | A | 10/1990 | Aebersold |
| 4,967,600 | A | 11/1990 | Keller |
| 4,969,603 | A | 11/1990 | Norman |
| 4,973,184 | A | 11/1990 | La Salle |
| D314,421 | S | 2/1991 | Tajima et al. |
| D314,588 | S | 2/1991 | Denham |
| 4,989,787 | A | 2/1991 | Nikkel et al. |
| 5,020,700 | A | 6/1991 | Krzywdziak et al. |
| D318,877 | S | 8/1991 | Miranda et al. |
| 5,042,840 | A | 8/1991 | Rieple et al. |
| D321,597 | S | 11/1991 | Cerny |
| 5,064,119 | A | 11/1991 | Mellette |
| 5,071,074 | A | 12/1991 | Lind |
| 5,074,334 | A | 12/1991 | Onodera |
| 5,078,323 | A | 1/1992 | Frank |
| 5,080,285 | A | 1/1992 | Toth |
| 5,088,648 | A | 2/1992 | Schmon |
| 5,090,623 | A | 2/1992 | Burns et al. |
| 5,102,045 | A | 4/1992 | Diana |
| 5,119,992 | A | 6/1992 | Grime |
| 5,125,391 | A | 6/1992 | Srivastava et al. |
| 5,135,124 | A | 8/1992 | Wobser |
| 5,143,102 | A | 9/1992 | Blaul |
| 5,165,605 | A | 11/1992 | Morita et al. |
| 5,170,941 | A | 12/1992 | Morita et al. |
| 5,190,219 | A | 3/1993 | Copp, Jr. |
| 5,191,797 | A | 3/1993 | Smith |
| 5,228,488 | A | 7/1993 | Fletcher |

(56) References Cited

U.S. PATENT DOCUMENTS 5,232,299 A 8/1993 Hiss
5,236,128 A 8/1993 Morita et al.
5,249,746 A 10/1993 Kaneko et al.
D341,186 S 11/1993 Albers
5,289,974 A 3/1994 Grime et al.
5,322,221 A 6/1994 Anderson
5,325,473 A 6/1994 Monroe et al.
5,332,156 A 7/1994 Wheeler
5,333,506 A 8/1994 Smith et al.
5,333,908 A 8/1994 Dorney et al.
5,344,078 A 9/1994 Fritz et al.
5,367,148 A 11/1994 Storch et al.
D353,836 S 12/1994 Carvelli et al.
5,381,962 A 1/1995 Teague
5,435,491 A 7/1995 Sakuma
5,443,642 A 8/1995 Bienduga
5,456,414 A 10/1995 Burns et al.
D365,952 S 1/1996 Gagnon et al.
5,503,439 A 4/1996 LaJeunesse et al.
5,533,674 A 7/1996 Feyrer et al.
5,540,385 A 7/1996 Garlick
5,540,386 A 7/1996 Roman
D376,637 S 12/1996 Kieffer
5,582,350 A 12/1996 Kosmyna et al.
5,584,899 A 12/1996 Shorts
5,588,562 A 12/1996 Sander et al.
5,592,597 A 1/1997 Kiss
5,609,302 A 3/1997 Smith
5,613,637 A 3/1997 Schmon
D380,301 S 7/1997 Kogutt
5,655,714 A 8/1997 Kieffer et al.
5,662,444 A 9/1997 Schmidt, Jr.
5,695,125 A 12/1997 Kumar
5,704,381 A 1/1998 Millan et al.
5,718,767 A 2/1998 Crum et al.
D391,403 S 3/1998 Josephs
RE35,769 E 4/1998 Grime et al.
5,755,363 A 5/1998 Gantner et al.
5,762,228 A 6/1998 Morgan et al.
5,803,360 A 9/1998 Spitznagel
5,816,501 A 10/1998 LoPresti et al.
5,836,517 A 11/1998 Burns et al.
D402,820 S 12/1998 Morison et al.
5,843,515 A 12/1998 Crum et al.
5,853,014 A 12/1998 Rosenauer
D405,503 S 2/1999 Edo
5,874,680 A 2/1999 Moore
5,884,006 A 3/1999 Frohlich et al.
D409,719 S 5/1999 Kaneko
5,941,461 A 8/1999 Akin et al.
5,951,190 A 9/1999 Wilson
5,951,296 A 9/1999 Klein
5,954,268 A 9/1999 Joshi et al.
D414,636 S 10/1999 Wiese
5,979,797 A 11/1999 Castellano
5,992,763 A 11/1999 Smith et al.
6,006,930 A 12/1999 Dreyer et al.
6,010,082 A 1/2000 Peterson
6,017,394 A 1/2000 Crum et al.
6,019,294 A 2/2000 Anderson
6,036,109 A 3/2000 DeYoung
6,039,218 A 3/2000 Beck
6,053,429 A 4/2000 Chang
6,056,213 A 5/2000 Ruta et al.
6,089,471 A 7/2000 Scholl
6,089,607 A 7/2000 Keeney et al.
6,091,053 A 7/2000 Aonuma
6,092,740 A 7/2000 Liu
6,132,511 A 10/2000 Crum et al.
D435,379 S 12/2000 Nguyen
6,250,567 B1 6/2001 Lewis et al.
6,276,616 B1 8/2001 Jenkins
D448,451 S 9/2001 Turnbull et al.
6,308,991 B1 10/2001 Royer
D457,599 S 5/2002 Karwoski
D459,432 S 6/2002 Schmon
D459,433 S 6/2002 Schmon
6,402,058 B2 6/2002 Kaneko et al.
6,402,062 B1 6/2002 Bendig et al.
6,431,466 B1 8/2002 Kitajima
6,435,426 B1 8/2002 Copp, Jr.
6,442,276 B1 8/2002 Doljack
6,450,422 B1 9/2002 Maggio
6,494,387 B1 12/2002 Kaneko
6,536,684 B1 3/2003 Wei
6,536,687 B1 3/2003 Navis et al.
D472,730 S 4/2003 Sparkowski
6,540,114 B1 4/2003 Popovich et al.
6,543,632 B1 4/2003 McIntyre et al.
6,547,884 B1 4/2003 Crum et al.
6,553,712 B1 4/2003 Majerowski et al.
6,554,009 B1 4/2003 Beijbom et al.
D474,528 S 5/2003 Huang
6,585,173 B2 7/2003 Schmon et al.
6,595,441 B2 7/2003 Petrie et al.
6,626,382 B1 9/2003 Liu
6,626,383 B1 9/2003 Campbell
6,647,997 B2 11/2003 Mohn
6,661,438 B1 12/2003 Shiraishi et al.
D485,685 S 1/2004 Zupkofska et al.
6,675,845 B2 1/2004 Volpenheim et al.
6,692,118 B2 2/2004 Michele et al.
6,712,292 B1 3/2004 Gosis et al.
6,717,584 B2 4/2004 Kulczycka
6,732,751 B2 5/2004 Chiang
6,763,964 B1 7/2004 Hurlbut et al.
6,766,763 B2 7/2004 Crum et al.
6,786,345 B2 9/2004 Richards
6,796,514 B1 9/2004 Schwartz
6,801,211 B2 10/2004 Forsline et al.
6,820,824 B1 11/2004 Joseph et al.
6,843,390 B1 1/2005 Bristor
6,845,924 B2 1/2005 Schmon
6,855,173 B2 2/2005 Ehrnsperger et al.
6,863,310 B1 3/2005 Petkovsek
6,863,920 B2 3/2005 Crum et al.
6,874,656 B2 4/2005 Rohr et al.
6,874,664 B1 4/2005 Montgomery
6,874,708 B2 4/2005 Reetz, III
6,877,677 B2 4/2005 Schmon et al.
6,929,019 B2 8/2005 Weinmann et al.
6,945,429 B2 9/2005 Gosis et al.
6,955,180 B2 10/2005 Kocherlakota et al.
6,962,432 B2 11/2005 Hofeldt
6,963,331 B1 11/2005 Kobayashi et al.
7,017,838 B2 3/2006 Schmon
7,018,154 B2 3/2006 Schmon
D519,687 S 4/2006 Zahav
7,032,839 B2 * 4/2006 Blette ..... B05B 7/02 239/290
7,036,752 B1 5/2006 Hsiang
7,083,119 B2 8/2006 Bouic et al.
7,090,148 B2 8/2006 Petrie et al.
7,097,118 B1 8/2006 Huang
D528,192 S 9/2006 Nicholson
7,106,343 B1 9/2006 Hickman
7,165,732 B2 1/2007 Kosmyna et al.
7,172,139 B2 2/2007 Bouic et al.
7,175,110 B2 2/2007 Vicentini
7,182,213 B2 2/2007 King
D538,050 S 3/2007 Tardif
D538,493 S 3/2007 Zimmerle et al.
D538,886 S 3/2007 Huang
7,194,829 B2 3/2007 Boire et al.
D541,053 S 4/2007 Sanders
D541,088 S 4/2007 Nesci
7,201,336 B2 4/2007 Blette et al.
7,216,813 B2 5/2007 Rogers
D545,943 S 7/2007 Rodgers et al.
7,246,713 B2 7/2007 King
7,249,519 B2 7/2007 Rogers
D548,816 S 8/2007 Schmon
7,255,293 B2 8/2007 Dodd
7,264,131 B2 9/2007 Tsutsumi et al.

(56) References Cited

U.S. PATENT DOCUMENTS

D552,213 S 10/2007 Schmon
D552,715 S 10/2007 Schmon
D554,703 S 11/2007 Josephson
D563,505 S 3/2008 Schmon
7,374,111 B2 5/2008 Joseph et al.
D571,463 S 6/2008 Chesnin
7,384,004 B2 6/2008 Rogers
RE40,433 E 7/2008 Sata
D573,227 S 7/2008 Mirazita et al.
D574,926 S 8/2008 Huang
D575,374 S 8/2008 Huang
7,410,106 B2 8/2008 Escoto, Jr. et al.
7,416,140 B2 8/2008 Camilleri et al.
7,422,164 B2 9/2008 Matsumoto
D579,213 S 10/2008 Aipa
D581,107 S 11/2008 Schmon
D581,483 S 11/2008 Bass et al.
D583,013 S 12/2008 Wang
7,458,612 B1 12/2008 Bennett
D588,231 S 3/2009 Pellin
7,533,678 B2 5/2009 Rosa
7,540,434 B2 6/2009 Gohring et al.
7,542,032 B2 6/2009 Kruse
7,568,638 B2 8/2009 Gehrung
D604,394 S 11/2009 Wang
7,614,571 B2 11/2009 Camilleri et al.
D607,086 S 12/2009 Kosaka
7,624,869 B2 12/2009 Primer
D607,972 S 1/2010 Wang
D608,858 S 1/2010 Baltz et al.
D614,731 S 4/2010 Wang
7,694,893 B2 4/2010 Zittel et al.
7,694,896 B2 4/2010 Turnbull et al.
D615,586 S 5/2010 Kudimi
D616,022 S 5/2010 Kudimi
D616,527 S 5/2010 Anderson et al.
7,765,876 B1 8/2010 Chen
D624,668 S 9/2010 Noppe
7,810,744 B2 10/2010 Schmon et al.
7,819,341 B2 10/2010 Schmon et al.
D627,039 S 11/2010 Yu
D627,432 S 11/2010 Escoto et al.
7,823,806 B2 11/2010 Schmon
D629,623 S 12/2010 Lampe
7,856,940 B2 12/2010 Wendler
7,913,938 B2 3/2011 Cooper
7,922,107 B2 4/2011 Fox
D637,269 S 5/2011 Wang
D638,121 S 5/2011 Villasana
D639,863 S 6/2011 Langan
D641,067 S 7/2011 Wang
D644,716 S 9/2011 Gehrung
D644,803 S 9/2011 Schmon
D645,094 S 9/2011 Langan
8,042,402 B2 10/2011 Brown et al.
D649,196 S 11/2011 Langan
8,052,071 B2 11/2011 Kruse
D655,347 S 3/2012 Gehrung
8,127,963 B2 3/2012 Gerson et al.
D657,276 S 4/2012 Brose
D661,492 S 6/2012 Ranschau
D661,742 S 6/2012 Clark
D663,960 S 7/2012 Jeronimo
8,225,892 B2 7/2012 Ben-Tzvi
D664,773 S 8/2012 Papin
8,240,579 B1 8/2012 Bennett
8,297,536 B2 10/2012 Ruda
D670,085 S 11/2012 Brookman
D671,988 S 12/2012 Leipold
D672,012 S 12/2012 Brose et al.
D674,880 S 1/2013 Schmon
8,352,744 B2 1/2013 Kruse
8,360,345 B2 1/2013 Micheli
D681,162 S 4/2013 Kruse
8,444,067 B2 5/2013 Schmon et al.
8,454,759 B2 6/2013 Selsvik
8,481,124 B2 7/2013 Nolte et al.
D689,590 S 9/2013 Brose
D689,593 S 9/2013 Schmon
D690,799 S 10/2013 Maier
D692,530 S 10/2013 Gehrung
D692,532 S 10/2013 Li et al.
8,616,434 B2 12/2013 Wilen
D697,584 S 1/2014 Schmon
D698,008 S 1/2014 Schmon et al.
8,626,674 B2 1/2014 Whitehouse
8,642,131 B2 2/2014 Nolte et al.
D704,300 S 5/2014 Li
8,757,182 B2 6/2014 Schmon
8,807,460 B2 8/2014 Charpie et al.
8,857,732 B2 10/2014 Brose
D720,015 S 12/2014 Kruse
D720,041 S 12/2014 Robinson
8,899,501 B2 12/2014 Fox et al.
D721,785 S 1/2015 Gehrung
8,925,836 B2 1/2015 Dettlaff
D733,369 S 6/2015 Tschan
D733,453 S 7/2015 Tschan
D734,571 S 7/2015 Tschan
9,073,068 B2 7/2015 Krayer et al.
D737,126 S 8/2015 Tschan
D740,393 S 10/2015 Gehrung
D745,636 S 12/2015 Lin
D757,216 S 5/2016 Gherung
D758,533 S 6/2016 Gehrung
D758,537 S 6/2016 Gehrung
D768,820 S 10/2016 Binz
D770,593 S 11/2016 Gehrung
9,878,336 B2 1/2018 Gehrung
2001/0004996 A1 6/2001 Schmon
2001/0040192 A1 11/2001 Kaneko et al.
2002/0134861 A1 9/2002 Petrie et al.
2002/0148501 A1 10/2002 Shieh
2002/0170978 A1 11/2002 Mohn
2003/0025000 A1 2/2003 Schmon et al.
2003/0066218 A1 4/2003 Schweikert
2003/0121476 A1 7/2003 McIntyre et al.
2003/0127046 A1 7/2003 Zehner et al.
2003/0164408 A1 9/2003 Schmon
2003/0177979 A1 9/2003 Crum et al.
2003/0189105 A1 10/2003 Schmon
2003/0209568 A1 11/2003 Douglas et al.
2003/0213857 A1 11/2003 Schmon et al.
2003/0218596 A1 11/2003 Eschler
2003/0230636 A1 12/2003 Rogers
2004/0046051 A1 3/2004 Santa Cruz et al.
2004/0050432 A1 3/2004 Breda
2004/0104194 A1 6/2004 Dennison
2004/0129738 A1 7/2004 Stukas
2004/0140373 A1 7/2004 Joseph et al.
2004/0155063 A1 8/2004 Hofeldt
2004/0177890 A1 9/2004 Weinmann
2004/0191406 A1 9/2004 Crum et al.
2004/0217201 A1 11/2004 Ruda
2004/0233223 A1 11/2004 Schkolne et al.
2004/0245208 A1 12/2004 Dennison
2005/0056613 A1 3/2005 King
2005/0082249 A1 4/2005 King
2005/0127201 A1 6/2005 Matsumoto
2005/0145723 A1 7/2005 Blette et al.
2005/0145724 A1 7/2005 Blette et al.
2005/0178854 A1 8/2005 Dodd
2005/0220943 A1 10/2005 Abrams et al.
2005/0248148 A1 11/2005 Schenck et al.
2005/0252993 A1 11/2005 Rogers
2005/0252994 A1 11/2005 Rogers
2005/0268949 A1 12/2005 Rosa
2005/0284963 A1 12/2005 Reedy
2006/0000927 A1 1/2006 Ruda
2006/0007123 A1 1/2006 Wilson et al.
2006/0048803 A1 3/2006 Jessup et al.
2006/0081060 A1 4/2006 Forster
2006/0113409 A1 6/2006 Camilleri et al.
2006/0171771 A1 8/2006 Kruse

(56) References Cited

U.S. PATENT DOCUMENTS

| | | | | |
|---|---|---|---|---|
| 2006/0192377 | A1 | 8/2006 | Bauer et al. | |
| 2006/0196891 | A1 | 9/2006 | Gerson et al. | |
| 2007/0029788 | A1 | 2/2007 | Adler | |
| 2007/0055883 | A1 | 3/2007 | Kruse | |
| 2007/0131795 | A1 | 6/2007 | Abbate et al. | |
| 2007/0158349 | A1 | 7/2007 | Schmon et al. | |
| 2007/0205305 | A1 | 9/2007 | Vagedes | |
| 2007/0221754 | A1 | 9/2007 | Gehrung | |
| 2007/0252378 | A1 | 11/2007 | Chambers | |
| 2008/0011879 | A1 | 1/2008 | Gerson et al. | |
| 2008/0019789 | A1 | 1/2008 | Dunaway et al. | |
| 2008/0029619 | A1 | 2/2008 | Gohring et al. | |
| 2008/0128533 | A1 | 6/2008 | Gehrung | |
| 2008/0179763 | A1 | 7/2008 | Schmon et al. | |
| 2008/0251977 | A1 | 10/2008 | Naruse et al. | |
| 2008/0264892 | A1 | 10/2008 | Nozawa | |
| 2008/0272213 | A1 | 11/2008 | Ting | |
| 2008/0296410 | A1* | 12/2008 | Carey et al. | 239/526 |
| 2009/0014557 | A1 | 1/2009 | Schmon et al. | |
| 2009/0026290 | A1* | 1/2009 | Fox | 239/345 |
| 2009/0045623 | A1 | 2/2009 | Schmon | |
| 2009/0072050 | A1 | 3/2009 | Ruda | |
| 2009/0078789 | A1 | 3/2009 | Kruse | |
| 2009/0078790 | A1 | 3/2009 | Camilleri et al. | |
| 2009/0143745 | A1 | 6/2009 | Langan et al. | |
| 2009/0183516 | A1 | 7/2009 | Appler et al. | |
| 2009/0235864 | A1 | 9/2009 | Khoury et al. | |
| 2009/0266915 | A1* | 10/2009 | Fedorov | B05B 7/064 239/303 |
| 2010/0021646 | A1 | 1/2010 | Nolte et al. | |
| 2010/0059533 | A1 | 3/2010 | Unger et al. | |
| 2010/0084493 | A1* | 4/2010 | Troudt | 239/526 |
| 2010/0108783 | A1 | 5/2010 | Joseph et al. | |
| 2010/0126541 | A1 | 5/2010 | Schmon | |
| 2010/0206963 | A1 | 8/2010 | Huang | |
| 2011/0024524 | A1* | 2/2011 | Fox | 239/302 |
| 2011/0121103 | A1* | 5/2011 | Carleton et al. | 239/337 |
| 2011/0125607 | A1 | 5/2011 | Wilen | |
| 2011/0127767 | A1 | 6/2011 | Wicks et al. | |
| 2011/0168811 | A1 | 7/2011 | Fox et al. | |
| 2011/0174901 | A1 | 7/2011 | Dettlaff et al. | |
| 2012/0012671 | A1 | 1/2012 | Brose et al. | |
| 2012/0097762 | A1 | 4/2012 | Gehrung et al. | |
| 2012/0132550 | A1 | 5/2012 | Gerson et al. | |
| 2012/0160935 | A1 | 6/2012 | Krayer et al. | |
| 2012/0187220 | A1 | 7/2012 | Micheli et al. | |
| 2013/0056556 | A1 | 3/2013 | Schmon et al. | |
| 2013/0074864 | A1* | 3/2013 | Nuzzo et al. | 132/212 |
| 2013/0266734 | A1 | 10/2013 | Nolte et al. | |
| 2013/0320110 | A1 | 12/2013 | Brose et al. | |
| 2014/0048627 | A1 | 2/2014 | Schmon et al. | |
| 2014/0059905 | A1 | 3/2014 | Raming | |
| 2014/0145003 | A1 | 5/2014 | Schmon et al. | |
| 2014/0305962 | A1 | 10/2014 | Tschan | |
| 2015/0165463 | A1 | 6/2015 | Gehrung | |
| 2015/0231655 | A1 | 8/2015 | Adams et al. | |
| 2016/0030960 | A1 | 2/2016 | Gehrung | |

FOREIGN PATENT DOCUMENTS

| | | | |
|---|---|---|---|
| AT | 250467 | | 10/2003 |
| AT | 322645 | | 4/2006 |
| AT | 383910 | | 2/2008 |
| AT | 461752 | | 4/2010 |
| AT | 461753 | | 4/2010 |
| AT | 475488 | | 8/2010 |
| AU | 637187 | | 5/1993 |
| AU | 2002352235 | | 9/2003 |
| AU | 2004315547 | | 8/2005 |
| AU | 2005205899 | | 8/2005 |
| AU | 2011257605 | | 11/2012 |
| AU | 2011361295 | | 5/2013 |
| CA | 521511 | | 2/1956 |
| CA | 2126957 | | 1/1995 |
| CA | 2277096 | | 7/1998 |
| CA | 2445183 | | 10/2002 |
| CA | 2552390 | | 8/2005 |
| CA | 2555607 | | 8/2005 |
| CA | 2690112 | | 5/2009 |
| CA | 2797990 | | 12/2011 |
| CA | 2812684 | | 9/2012 |
| CA | 102917803 | | 2/2013 |
| CA | 2850401 | A1 | 5/2013 |
| CH | 203 668 | | 6/1939 |
| CH | 542104 | A | 9/1973 |
| CH | 676208 | | 12/1990 |
| CN | 2136077 | Y | 6/1993 |
| CN | 1902002 | | 1/2007 |
| CN | 1909970 | | 2/2007 |
| CN | 1909971 | | 2/2007 |
| CN | 1917960 | | 2/2007 |
| CN | 200954482 | | 10/2007 |
| CN | 101125316 | | 2/2008 |
| CN | 100430150 | | 11/2008 |
| CN | 100455360 | | 1/2009 |
| CN | 101367066 | | 2/2009 |
| CN | 100478080 | | 4/2009 |
| CN | 101646500 | | 2/2010 |
| CN | 102211070 | | 4/2011 |
| CN | 102211069 | | 10/2011 |
| CN | 203508251 | U | 4/2014 |
| DE | 460381 | | 5/1928 |
| DE | 611325 | C | 3/1935 |
| DE | 1425890 | | 11/1968 |
| DE | 2653981 | | 6/1978 |
| DE | 2950341 | | 7/1980 |
| DE | 3016419 | | 11/1981 |
| DE | 8024829.9 | | 9/1982 |
| DE | 3111571 | A1 | 10/1982 |
| DE | 34 02 097 | | 8/1985 |
| DE | 3402945 | A1 | 8/1985 |
| DE | 3517122 | | 5/1986 |
| DE | 3505618 | | 8/1986 |
| DE | 3526819 | | 2/1987 |
| DE | 3016419 | C2 | 8/1987 |
| DE | 8702559 | | 10/1987 |
| DE | 3708472 | A1 | 10/1988 |
| DE | 8902223 | | 5/1989 |
| DE | 3742308 | | 6/1989 |
| DE | 8905681 | | 11/1989 |
| DE | G 90 01 265 | | 5/1990 |
| DE | 3906219 | | 8/1990 |
| DE | 4302911 | | 8/1993 |
| DE | 4230535 | | 3/1994 |
| DE | G 97 16 015.5 | U1 | 11/1994 |
| DE | 4321940 | | 1/1995 |
| DE | 19516485 | | 11/1996 |
| DE | 19727884 | | 2/1999 |
| DE | 69505433 | T2 | 4/1999 |
| DE | 19807973 | | 7/1999 |
| DE | 19824264 | | 12/1999 |
| DE | 19832990 | | 1/2000 |
| DE | 20000483 | | 8/2000 |
| DE | 10004105 | | 10/2000 |
| DE | 19958569 | | 2/2001 |
| DE | 199 41 362 | | 3/2001 |
| DE | 199 45 760 | | 3/2001 |
| DE | 19945760 | | 3/2001 |
| DE | 10031857 | | 1/2002 |
| DE | 10031858 | | 1/2002 |
| DE | 20114257 | | 2/2002 |
| DE | 10059406 | | 6/2002 |
| DE | 10135104 | | 9/2002 |
| DE | 102 05 831 | | 8/2003 |
| DE | 10205831 | | 8/2003 |
| DE | 10311238 | | 10/2004 |
| DE | 10 2004 027 789 | | 2/2005 |
| DE | 29825120 | | 2/2005 |
| DE | 102004027789 | | 2/2005 |
| DE | 102004027789 | A1 | 2/2005 |
| DE | 20320781 | | 6/2005 |
| DE | 10 2004 014 646 | | 7/2005 |
| DE | 10 2004 003 438 | | 8/2005 |

(56) References Cited

FOREIGN PATENT DOCUMENTS

| | | | |
|---|---|---|---|
| DE | 102004003439 | | 8/2005 |
| DE | 10 2004 007 733 | | 9/2005 |
| DE | 10 2004 021 298 | | 11/2005 |
| DE | 69535077 | T2 | 11/2006 |
| DE | 202007001031 | | 3/2007 |
| DE | 60200500 1173 | | 8/2007 |
| DE | 60206956 | T2 | 8/2008 |
| DE | 102007006547 | | 8/2008 |
| DE | 102007039106 | | 2/2009 |
| DE | 102007052067 | | 5/2009 |
| DE | 202010012449 | | 12/2010 |
| DE | 102009032399 | A1 | 1/2011 |
| DE | 102009053449 | | 2/2011 |
| DE | 102010060086 | | 4/2012 |
| DE | 102011106060 | | 1/2013 |
| DE | 102011118120 | | 5/2013 |
| EP | 0092392 | | 10/1983 |
| EP | 0313958 | A2 | 5/1989 |
| EP | 524408 | | 1/1993 |
| EP | 567325 | | 10/1993 |
| EP | 0631821 | | 1/1995 |
| EP | 0650766 | | 5/1995 |
| EP | 0650766 | A2 | 5/1995 |
| EP | 678334 | | 10/1995 |
| EP | 0706832 | | 4/1996 |
| EP | 0710506 | | 5/1996 |
| EP | 801002 | | 10/1997 |
| EP | 987060 | | 3/2000 |
| EP | 1081639 | | 3/2001 |
| EP | 1106262 | | 6/2001 |
| EP | 1 247 586 | | 10/2002 |
| EP | 1247586 | | 10/2002 |
| EP | 1277519 | | 1/2003 |
| EP | 1294490 | | 3/2003 |
| EP | 1299194 | | 4/2003 |
| EP | 1366823 | | 12/2003 |
| EP | 1412669 | | 4/2004 |
| EP | 1424135 | | 6/2004 |
| EP | 1477232 | A1 | 11/2004 |
| EP | 1479447 | A1 | 11/2004 |
| EP | 1504823 | A1 | 2/2005 |
| EP | 1563913 | | 8/2005 |
| EP | 1574262 | | 9/2005 |
| EP | 1602412 | | 12/2005 |
| EP | 1658902 | A1 | 5/2006 |
| EP | 1708822 | | 10/2006 |
| EP | 1708823 | | 10/2006 |
| EP | 1718415 | | 11/2006 |
| EP | 1880771 | A1 | 1/2008 |
| EP | 1902766 | A1 | 3/2008 |
| EP | 1902786 | | 3/2008 |
| EP | 1902876 | | 3/2008 |
| EP | 1930084 | | 6/2008 |
| EP | 1964616 | | 9/2008 |
| EP | 1964616 | A2 | 9/2008 |
| EP | 1997561 | A2 | 12/2008 |
| EP | 2027931 | | 2/2009 |
| EP | 2092987 | A1 | 8/2009 |
| EP | 2106298 | | 10/2009 |
| EP | 2111920 | | 10/2009 |
| EP | 2490819 | | 8/2012 |
| EP | 2576079 | | 4/2013 |
| EP | 2608890 | | 7/2013 |
| EP | 2 669 213 | A1 | 12/2013 |
| EP | 2703089 | A1 | 3/2014 |
| FR | 398333 | | 6/1909 |
| FR | 398333 | A | 6/1909 |
| FR | 789762 | | 11/1935 |
| FR | 1410519 | | 9/1964 |
| FR | 2444501 | | 7/1980 |
| FR | 2462200 | A1 | 2/1981 |
| FR | 2 570 140 | | 3/1986 |
| FR | 2 774 928 | | 8/1999 |
| FR | 2927824 | A1 | 8/2009 |
| GB | 190900523 | | 6/1909 |
| GB | 2 132 916 | | 7/1984 |
| GB | 2153260 | | 8/1985 |
| GB | 2372465 | | 8/2002 |
| GB | 2411235 | | 8/2005 |
| HK | 1100405 | | 6/2009 |
| HK | 1096057 | | 7/2009 |
| HK | 1125067 | | 8/2012 |
| HK | 1138533 | | 11/2012 |
| JP | S49-136868 | U | 11/1974 |
| JP | S5654328 | | 5/1981 |
| JP | S57-75246 | | 5/1982 |
| JP | 58-119862 | | 5/1983 |
| JP | S5998757 | | 6/1984 |
| JP | S601722 | | 1/1985 |
| JP | H01-87805 | | 6/1989 |
| JP | H0530749 | | 4/1993 |
| JP | H05172678 | | 7/1993 |
| JP | 674850 | | 3/1994 |
| JP | H06215741 | | 8/1994 |
| JP | H08196950 | | 8/1996 |
| JP | H08196950 | A | 8/1996 |
| JP | H09117697 | | 5/1997 |
| JP | 11-047643 | A | 2/1999 |
| JP | 2001259487 | | 9/2001 |
| JP | 2003042882 | | 2/2002 |
| JP | 2003088780 | | 3/2003 |
| JP | 2004017044 | | 1/2004 |
| JP | 2005138885 | | 6/2005 |
| JP | 2007516831 | | 6/2007 |
| JP | 2010-528837 | A | 8/2010 |
| TW | 491092 | | 6/2002 |
| TW | I220392 | | 8/2004 |
| TW | I303587 | | 12/2008 |
| TW | I309584 | | 5/2009 |
| WO | 90/008456 | | 8/1990 |
| WO | 91/16610 | | 10/1991 |
| WO | 1992/07346 | | 4/1992 |
| WO | 9522409 | | 8/1995 |
| WO | 1998/32539 | | 7/1998 |
| WO | 01/012337 | | 2/2001 |
| WO | 2001/12337 | | 2/2001 |
| WO | 0166261 | | 9/2001 |
| WO | 01/099062 | | 12/2001 |
| WO | 02/000355 | | 1/2002 |
| WO | 0202242 | | 1/2002 |
| WO | 02/018061 | | 3/2002 |
| WO | 02/085533 | | 10/2002 |
| WO | 03/007252 | | 1/2003 |
| WO | 03/045575 | | 6/2003 |
| WO | 03/069208 | | 8/2003 |
| WO | 03069208 | A1 | 8/2003 |
| WO | 04/037433 | | 5/2004 |
| WO | 2004/37433 | | 5/2004 |
| WO | 04/052552 | | 6/2004 |
| WO | 05/018815 | | 3/2005 |
| WO | 05/068220 | | 7/2005 |
| WO | 05/070557 | | 8/2005 |
| WO | 05/070558 | | 8/2005 |
| WO | 05/077543 | | 8/2005 |
| WO | 05/115631 | | 12/2005 |
| WO | 2006065850 | | 6/2006 |
| WO | 07/128127 | | 11/2007 |
| WO | 2007133386 | A2 | 11/2007 |
| WO | 2007/149760 | A2 | 12/2007 |
| WO | 2009015260 | | 1/2009 |
| WO | 2009015260 | A2 | 1/2009 |
| WO | 2009/054986 | A1 | 4/2009 |
| WO | 2009056424 | | 5/2009 |
| WO | 2010019274 | A1 | 2/2010 |
| WO | 2010/044864 | A1 | 4/2010 |
| WO | 2011047876 | | 4/2011 |
| WO | 2011147555 | | 12/2011 |
| WO | 2012119664 | | 9/2012 |
| WO | 2013000524 | | 1/2013 |

(56) References Cited

FOREIGN PATENT DOCUMENTS

| | | |
|---|---|---|
| WO | 2013016474 | 1/2013 |
| WO | 2013/131626 A1 | 9/2013 |

OTHER PUBLICATIONS

International Search Report dated Sep. 6, 2012 for International Application No. PCT/EP2012/001939 with English translation.
International Preliminary Report on Patentability (IPRP) dated Jan. 7, 2014 for International Patent Application No. PCT/EP2012/001939 filed on May 5, 2012.
Canadian Office Action dated Nov. 21, 2012 for related application CA2741703.
Chinese Search Report dated Dec. 5, 2012 for related application CN200980135429.9.
Chinese Office Action dated Dec. 13, 2012 for related application CN200980135429.9.
German Search Report for DE 20 2008 014 389.6 completed Jul. 13, 2009.
Application filed Mar. 3, 2015, 2015 for Design U.S. Appl. No. 29/519,198.
Notice of Allowance dated Nov. 19, 2014 for U.S. Appl. No. 29/486,223.
Office Action dated Dec. 31, 2014 for U.S. Appl. No. 13/380,949.
Restriction Requirement dated Jan. 9, 2015 for Design U.S. Appl. No. 29/469,049.
Response to Office Action filed Dec. 2, 2014 for U.S. Appl. No. 29/487,679.
Notice of Allowance dated Jan. 15, 2015 for Design U.S. Appl. No. 29/490,620.
Office Action dated Jan. 14, 2015 for Design U.S. Appl. No. 29/447,887.
Hercules Paint Gun Washers brochure publish date Jan. 2012, [online], [site visited Jan. 7, 2015], <http://www.herkules.us/pdfs/L00761-Hercules-Gun_Washers-4-page-brochure.pdf>.
Jetclean GUn Cleaner Terry's Auto Supply, google publish date Aug. 4, 2011, [online], [site visited Jan. 7, 2015], <http://secure.terrys.net/viewProduct.php?productID=FT.FHAZ1005>.
Restriction Requirement dated Feb. 6, 2015 for Design U.S. Appl. No. 29/486,232.
Office Action dated Mar. 30, 2015 for U.S. Appl. No. 13/698,417.
Responde to Office Action filed Apr. 14, 2015 to Office Action dated Jan. 14, 2015 for U.S. Appl. No. 29/447,887.
Response filed Jul. 20, 2015 for Office Action dated Mar. 30, 2015 for U.S. Appl. No. 13/698,417.
Notice of Allowance dated Apr. 30, 2015 for U.S. Appl. No. 29/447,887.
Chinese Office Action dated Oct. 28, 2014 and Search Report dared Oct. 15, 2014 for Chinese Application No. 2011800266029.
Australian Examination Report dated Oct. 30, 2012 for Australian Application No. 2010268870.
Notice of Allowance dated Apr. 24, 2015 for Design U.S. Appl. No. 29/486,232.
Restriction Requirement dated Jan. 22, 2015 for U.S. Appl. No. 13/698,417.
Response filed Mar. 23, 2015 to Restriction Requirement dated Jan. 22, 2015 for U.S. Appl. No. 13/698,417.
Response filed Apr. 6, 2015 to Office Action dated Feb. 6, 2015 for Design U.S. Appl. No. 29/486,232.
Response filed Mar. 31, 2015 to Office Action dated Dec. 31, 2014 for U.S. Appl. No. 13/380,949.
Japanese Office Action dated Jun. 11, 2014 for Japanese Patent Application No. 2012-518769.
Australian Examination Report dated Nov. 11, 2014 for Australian patent Application No. 2011257605.
Japanese Notice of Allowance dated Jan. 13, 2015 for Japanese Patent Application No. 2012/518769.
Application filed Dec. 11, 2011 for U.S. Appl. No. 13/380,949.
Chinese Office Action dated Jan. 28, 2014 and Search Report dated Jan. 21, 2014 for Chinese Application No. 201080030935.4.
Search Report dated Apr. 24, 2010 for German Application No. 10 2009 032 399.6-51.
Application filed Jan. 29, 2015 for Design U.S. Appl. No. 29/516,082.
Application filed Jan. 29, 2015 for Design U.S. Appl. No. 29/516,073.
Application filed Dec. 17, 2014 for U.S. Appl. No. 14/572,998.
German Search Report dated Mar. 25, 2014 for German Application No. 202013105779-7.
Application filed Nov. 16, 2012 for U.S. Appl. No. 13/698,417.
Application filed Jun. 2, 2013 for U.S. Appl. No. 13/991,285.
English translation of application filed Aug. 13, 2013 for Application filed Jun. 2, 2013 for U.S. Appl. No. 13/991,285.
Restriction Requirement dated May 27, 2015 for U.S. Appl. No. 13/991,285.
Response to Restriction Requirement filed Jul. 27, 2015 to Restriction Requirement dated May 27, 2015 for U.S. Appl. No. 13/991,285.
Application filed Jul. 31, 2015 for U.S. Appl. No. 14/815,210.
Final Office Action dated Aug. 4, 2015 for U.S. Appl. No. 13/380,949.
Notice of Allowance dated Aug. 3, 2015 for U.S. Appl. No. 29/486,232.
Office Action dated Aug. 7, 2015 for U.S. Appl. No. 13/991,285.
Response filed Oct. 6, 2015 to Notice of Non-Compliant Amendment for U.S. Appl. No. 13/698,417.
Notice of Non-Compliant Amendment dated Aug. 10, 2015 for U.S. Appl. No. 13/698,417.
Final Office Action dated Oct. 16, 2015 for U.S. Appl. No. 13/698,417.
Extended European Search Report dated Apr. 17, 2015 for European Application No. 14004167.4.
Printout from Internet www.ehow.com explaining how to choose a spray gun and stating in item 2 "Nozzle sizes vary between about 1 mm and 2 mm.", printed Sep. 7, 2012.
Printout from Internet www.bodyshopbusiness.com explaining how to choose nozzle setup in paragraph bridging pp. 1 and 2, giving general rule of thumb of nozzle sizes from 13 mm to 2.2 mm, depending on material being sprayed, printed Sep. 7, 2012.
Printout from Internet of pages from brochure of Walther Pilot showing nozzle sizes for spray guns ranging from 0.3 mm to 2.5 mm, dated 2007.
Printout from Internet www.alsacorp.com showing in the paragraph bridging pp. 2 and 3, Model VS-7200 Saber LVLP spray gun with nozzle size 1.3 mm with sizes 13 to 2.0 available, printed Aug. 26, 2012.
Printout from Internet of p. 28 from current 3Mtm brochure showing Tip/Nozzle/Air Cap Selection Guide with nozzle sizes from 0.5 mm to 3.0 mm.
Decision by EPO regarding opposition proceedings to revoke patent No. 99926841.0-2425/ 1108476, corresponding to '387 patent, 2012.
SATA News Publication Dan-Am Jul.-Sep. 1996.
SATA News Publication Dan-Am Oct.-Dec. 1996.
SATA News Publication Dan-Am Apr.-Jun. 1998.
Dan-Am SATA Catalog 6 for spray guns 1991.
Dan-Am SATA Catalog 8 for spray guns 1994.
Dan-Am Catalog 6—51pp published 1991.
Japanese Industrial Standards B 9809 English translation, 1992.
Japanese Industrial Standards B 9809 revised Mar. 1, 1991.
SATA News, vol. 21, 2009.
Collision Hub TV Document (image from video clip) printed Oct. 9, 2013.
MyRielsMe.com document from press release printed Oct. 9, 2013.
How to set Air pressure, Utube screenshot printed Oct. 9, 2013.
Ohio EPA Letty to Tony Larimer, response to letter dated Aug. 2006.
Pinahs Ben-Tzvi et al, A conceptual design . . . , Mechatrronics 17 (2007) p. 1-13.
On line ad from Amazon.com printed Oct. 14, 2013.
Rone et al, MEMS-Baed Microdroplet Generation with Integrated Sensing, COMSOL, 2011.
International Search Report (dated Jun. 20, 2008), Written Opinion (dated Jun. 20, 2008), and International Preliminary Report on Patentability (dated Sep. 14, 2010) from PCT/US2008/03318 filed Mar. 12, 2008.

(56) References Cited

OTHER PUBLICATIONS

Response filed Dec. 7, 2015 to Office Action dated Aug. 7, 2015 for U.S. Appl. No. 13/991,285.
International Search Report, Written Opinion and International Preliminary Report on Patentability for PCT/EP2004/005381 file May 19, 2004.
International Search Report, Written Opinion and International Preliminary Report on Patentability for PCT/EP2004/011998 filed Oct. 23, 2004.
International Search Report, Written Opinion and International Preliminary Report on Patentability for PCT/EP2005/000435 filed Jan. 18, 2005.
International Search Report, Written Opinion and International Preliminary Report on Patentability for PCT/EP2005/00437 filed Jan. 18, 2005.
International Search Report, Written Opinion and International Preliminary Report on Patentability for PCT/EP2008/063344, filed Oct. 6, 2008.
International Search Report, Written Opinion and International Preliminary Report on Patentability for PCT/EP2010/002392 filed Apr. 20, 2010.
International Search Report, Written Opinion and International Preliminary Report on Patentability for PCT/EP2011/002544 filed May 21, 2011.
International Search Report, Written Opinion and International Preliminary Report on Patentability for PCT/EP2011/066665 filed Sep. 26, 2011.
International Search Report, Written Opinion and International Preliminary Report on Patentability for PCT/EP2010/003399 filed Jun. 7, 2010.
International Search Report, Written Opinion and International Preliminary Report on Patentability for PCT/EP2011/5842 filed Dec 2, 2010.
International Search Report, Written Opinion and International Preliminary Report on Patentability for PCT/EP2012/01939 filed May 5, 2012.
International Search Report, Written Opinion and International Preliminary Report on Patentability for PCT/EP2009/06992 filed Sep. 29, 2009.
Internet Archive Wayback Machine [online] [captured Sep. 25, 2012] [retrieved on Sep. 8, 2014] retrieved from the Internet URL:http://web.archive.org/web/20120925210554/http://www.sata.com/index.php?id=sal-check&no cache=1&L=11.
JP Office Action issued against JP Patent App. 2012-508926 dated Feb. 25, 2014 with English translation.
Office Action dated Dec. 31, 2015 for U.S. Appl. No. 14/572,998.
Notice of Allowance dated Jan. 19, 2016 for Design U.S. Appl. No. 29/539,615.
Notice of Allowance dated Jan. 22, 2016 for U.S. Appl. No. 13/991,285.
Notice of Allowance dated Jan. 27, 2016 for Design U.S. Appl. No. 29/510,723.
Notification of the First Office Action with search report dated Aug. 24, 2015 for Chinese Application No. 201280020519.5 (related to U.S. Appl. No. 14/113,649), 13 pages.
Notification of the Second Office Action dated May 16, 2016, for Chinese Application No. 201280020519.5 (related to U.S. Appl. No. 14/113,649), 5 pages.
Japanese Office Action for JP2014-517485 (related to U.S. Appl. No. 14/113,649), dated Jul. 5, 2016, 16 pages.
Response to Office Action filed Feb. 16, 2016 for U.S. Appl. No. 13/698,417.
Screen shot of a SATA product (SATAjet B) description retrieved on Feb. 12, 2016 from www.sata.com/index.php.
"The Hot Rolling Process;" California Steel; retrieved on Feb. 12, 2016 from http://www.californiasteel.com/GetPublicFile.aspx?id=53.
Office Action dated Feb. 19, 2016 for U.S. Appl. No. 14/113,649.
Response to Final Office Action and RCE dated Nov. 29, 2016 in U.S. Appl. No. 14/113,649.
Notice of Allowance dated Apr. 18, 2016 for U.S. Appl. No. 14/572,998.
Response filed Apr. 27, 2016 to Office Action dated Jan. 29, 2016 for U.S. Appl. No. 13/380,949.
German Search Report dated Apr. 12, 2016 for related German Application No. 10 2015 008 735.5.
Response restriction requirement filed May 23, 2016 for Design U.S. Appl. No. 29/516,082.
Final Office Action dated Feb. 25, 2016 for U.S. Appl. No. 13/698,417.
Restriction Requirement dated Mar. 25, 2016 for Design U.S. Appl. No. 29/516,082.
Response filed Mar. 31, 2016 to Office Action dated Dec. 31, 2016 for U.S. Appl. No. 14/572,998.
Second Chinese Office Action dated Jun. 24, 2015 for Chinese Application No. 2011800266029.
Third Chinese Office Action dated Nov. 30, 2015 for Chinese Application No. 2011800266029.
Final Office Action dated Aug. 29, 2016 for U.S. Appl. No. 14/113,649.
Office Action dated Nov. 2, 2016 for U.S. Appl. No. 11/949,122.
Office Action from U.S. Appl. No. 15/143,698 dated Jan. 5, 2017.
Notice of Allowance in U.S. Appl. No. 29/556,463, filed Mar. 1, 2016, 9 pages.
Notice of Allowance in U.S. Appl. No. 29/555,656, filed Feb. 24, 2016, 5 pages.
Response to Restriction Requirement filed in U.S. Appl. No. 14/815,210 dated Jun. 19, 2017.
Restriction Requirement Office Action dated Apr. 17, 2017 for U.S. Appl. No. 14/815,210.
Notice of Allowance dated Apr. 10, 2017 for U.S. Appl. No. 29/579,824.
Response to Final Office Action filed May 9, 2017 in U.S. Appl. No. 13/698,417.
Response to Office Action filed May 17, 2017 in U.S. Appl. No. 14/113,649.
Office Action dated Jun. 30, 2017 for U.S. Appl. No. 14/815,210.
Final Office Action in U.S. Appl. No. 14/113,649 dated Jun. 22, 2017.
Response filed in U.S. Appl. No. 15/143,698 dated Jul. 3, 2017.
German Search Report for Application No. 10 2016 009 957.7 dated Apr. 21, 2017.
Written Opinion dated Sep. 8, 2016 for International Application No. PCT/EP2016/061057 filed May 18, 2016.
Final Office Action dated Dec. 7, 2017 for U.S. Appl. No. 14/815,210.
International Search Report dated Jul. 14, 2016 for International Application No. PCT/EP2016/000809, filed May 17, 2016.
Written Opinion for International Application No. PCT/EP2016/000809, filed May 17, 2016.
International Search Report dated Aug. 31, 2016 for PCT/EP2016/061057 filed May 18, 2016.
Written Opinion for PCT/EP2016/061057 filed May 18, 2016.
European Search Report dated May 8, 2017 for Application No. EP16203544.
"Spray Guns/sata.com", Oct. 18, 2015, XP055364928 URL:http://web.archive.org/web/20151018205307/http://www.sata.com/index.php?id=lackierpistolen&L=11 [gefunden am May 13, 2017]; reprinted on Dec. 8, 2017.
"SATAjet 5000 B Lackierpistolen | Bechersysteme | Atemschutz | Filtertechnik | Zubehor So flexibel wie Ihre Aufgaben" Apr. 11, 2017, XP055364477 Gefunden im Internet: URL:https/www.sata.com/uploads/tx_pxspecialcontent/00_SATAjet_5000_B.pdf [gefunden am May 12, 2017]; English translation of full brochure attached.
Amendments submitted to European Patent Office dated Dec. 3, 2017 for Application No. EP16203544 (with English translation of chart on p. 3).

* cited by examiner

EASY-TO-CLEAN SPRAY GUN, ACCESSORIES THEREFOR, AND MOUNTING AND DISMOUNTING METHODS

FIELD OF THE INVENTION

The invention pertains to an easy-to-clean spray gun, accessories therefor, as well as a mounting and a dismounting method.

BACKGROUND

Conventional spray guns essentially consist of a base body that features a handle and a head section and contains compressed air conduits, a nozzle set, a compressed air connection, a trigger, an air guidance system with an air valve, an air nozzle and a mechanism for adjusting the volume and the pressure of the air flowing through the compressed air conduits, as well as a material guidance system with a paint needle and a mechanism for adjusting the material volume. The spray gun head features a material-conveying region, through which the material to be sprayed flows from a spray medium inlet to a spray medium outlet that is typically realized in the form of a material nozzle. A material supply, for example, in the form of a reservoir or a supply line from an external material storage system is provided at the spray medium inlet. Conventional reservoirs consist, for example, of gravity-feed cups, suction-feed cups or laterally mounted cups. The pressure difference can be produced by means of a material conveying device or by means of air flowing past an opening on the material supply. All free-flowing materials such as, for example, paints, varnishes, adhesives or the like may be considered as spray mediums.

The compressed air required for the spraying process is supplied at the air connection that is arranged on or in the pistol grip. The air valve is opened by actuating the trigger up to a first pressure point. When the trigger is additionally pulled back, the paint needle is retracted from the spray nozzle. The spray medium then respectively flows out of the material nozzle due to the gravitational force or a pressure difference and is atomized by the compressed air exiting the air nozzle.

Spray guns of this type have proven themselves in practical applications for many decades. However, it is disadvantageous that they respectively require careful cleaning of the material-conveying regions after each use and before each material change because clogging of said regions, as well as a contamination of the spray medium, could otherwise occur. In the prior art, this problem is solved by utilizing a material guide in the form of a cartridge, i.e., in the form of an exchangeable insert or exchangeable spray medium guide unit, that preferably consists of a disposable article. For example, DE 3016419 C2 discloses an advantageous spray gun of this type with a holding region and with a head that is equipped with a cartridge, wherein the cartridge features an inlet region for a material-conveying conduit that ends in an outlet region, wherein the inlet region of the cartridge is connected or can be connected to a reservoir for the material to be sprayed, and wherein the cartridge preferably guides at least one material-conveying component of the spray gun. This spray gun has a head that is divided into two parts, and features a rear region with respect to the spraying direction and a front region with respect to [as] the spraying direction. The rear end of the front region of the two-part head is equipped with a plug-type fitting for a cartridge with a tubular material-conveying conduit that extends in the direction of the spray jet, and in the interior of which a nozzle needle or paint needle is respectively arranged. The nozzle needle can be moved back and forward in the direction of the spray jet by means of a lever and spring mechanism such that the material to be sprayed can pass the nozzle arranged in the outlet region. The cartridge is held in the head by means of pin connections. After its use, the pin connections can be disengaged and the two head regions can be pivoted apart from one another such that the cartridge including the paint needle can be removed from the head and then discarded. A new cartridge can then be respectively fixed on or in the spray gun. In this way, cleaning of the material-conveying regions of the spray gun is not required. However, the pin connections are relatively complicated, as well as difficult to manufacture and disengage, and also do not always ensure a flawless operational reliability.

Another spray gun with an exchangeable cartridge is described in DE 10 2004 027 789 A1. The object of this publication is a two-part spray gun, in which each of the two parts features a recess for accommodating an exchangeable paint medium guide unit. The exchangeable paint medium guide unit is inserted into the receptacle of the first gun part. The second gun part is subsequently attached to the first part and fixed with a screw. Due to these numerous preparatory steps, the set-up of the spray gun is very elaborate and time-consuming. The two-part design of the gun furthermore requires immense additional effort during the manufacture because the two gun parts are not identical such that two production lines are required. This increases the manufacturing costs of the spray gun. In addition, it is also difficult to seal the gun cavities relative to the outside air.

Another embodiment of a spray gun with an exchangeable cartridge is disclosed in WO 2009/015260 A2. In this case, the gun essentially also consists of two parts, namely a front and a rear part that are connected to one another by means of a hinge. In order to insert the cartridge, the front part is pivoted downward such that the cartridge receptacle is exposed. After inserting the cartridge, the front part is once again pivoted upward and connected to the rear part by means of a spring-loaded latch. Although this allows a faster insertion of the cartridge into the gun than in the above-described prior art, the quality of the hinge, particularly its accuracy and its stability, is subject to very strict requirements. The manufacturing effort is therefore very high in comparison with a conventional spray gun and the production is associated with substantial additional costs.

SUMMARY

It is therefore an objective of the present invention to develop a spray gun of the initially cited type that can be manufactured more cost-efficiently and functions reliably at all times, wherein particularly a cartridge or another type of exchangeable insert can be mounted on or in and once again removed from or out of said spray gun in a less complicated yet reliable fashion.

It is another objective of the invention to make available an exchangeable spray medium guide unit that is suitable for use in connection with an inventive spray gun with one-piece base body.

It is another objective of the present invention to develop a material supply device that is suitable for use in connection with an inventive spray gun with one-piece base body and an inventive exchangeable spray medium guide unit.

It is a fourth objective of the present invention to make available a cover that is suitable for use in connection with an inventive one-piece spray gun and an inventive exchangeable spray medium guide unit.

It is another objective of the present invention to make available a method, by means of which the exchangeable spray medium guide unit can be arranged in or on an inventive spray gun with one-piece base body.

It is yet another objective of the present invention to make available a method, by means of which the exchangeable spray medium guide unit can be removed from or out of an inventive spray gun with one-piece base body.

The first objective is attained with a spray gun with one-piece base body according to Claim 1 that, among other things, features a base body, a trigger, a paint needle-actuating element that is coupled to the trigger, a paint needle that is coupled to the paint needle-actuating element and an exchangeable spray medium guide unit, the inlet region of which is connected or can be connected to a material supply device for the material to be sprayed, wherein the base body features a recess for accommodating the exchangeable spray medium guide unit. In comparison with conventional multipiece spray guns according to the prior art, the spray gun with one-piece base body is characterized in that the base body of the gun consists of only one piece. No parts of the base body need to be moved such as, for example, pivoted, screwed on or unscrewed, clipped or bonded in order to insert or remove the exchangeable spray medium guide unit. Attachments remain unaffected by this one-piece design, i.e., the spray gun with one-piece base body may feature several attachments such as, e.g., a trigger, a circular/broad jet control, a locking screw, an air micrometer, a material volume control or the like.

The second objective is attained with an exchangeable spray medium guide unit that can be arranged in or on the one-piece spray gun. The exchangeable spray medium guide unit is designed for being arranged in or on the one-piece spray gun . . . .

The third objective is attained with a material supply device that can be arranged on the exchangeable spray medium guide unit or on the spray gun with one-piece base body or on both. The material supply device may consist of a gravity-feed cup, a suction-feed cup or a laterally mounted cup or of a supply line that is connected or can be connected to an external material storage system such as, e.g., a paint, varnish or adhesive container. In this way, the spray medium can respectively flow or be sucked into the exchangeable spray medium guide unit and into the spray gun with one-piece base body directly from the material supply device.

The fourth objective is attained with a cover that can be arranged on the exchangeable spray medium guide unit or on the spray gun with one-piece base body or on both. The cover may consist, for example, of an air distribution ring or a nozzle set that, for example, can be screwed on the base body by means of an air nozzle ring or arranged thereon otherwise.

The fifth objective is attained with a method in which the exchangeable spray medium guide unit is arranged in or on a recess of the base body of the spray gun with one-piece base body.

The sixth objective is attained with a method in which the exchangeable spray medium guide unit is removed from or out of a recess of a base body of the spray gun with one-piece base body.

Advantageous embodiments form the objects of the dependent claims.

The spray gun with one-piece base body may be designed for use in connection with any fluid or any aerosol such as, for example, for the application of paints, varnishes or adhesives onto objects.

The inventive spray gun with one-piece base body features a recess that is realized in such a way that it can accommodate an exchangeable spray medium guide unit. In the operating mode, a spray medium is supplied to the exchangeable spray medium guide unit through an inlet region. The spray medium flows through the exchangeable spray medium guide unit and then to a paint outlet, at which it exits the spray gun in an atomized fashion downstream of the nozzle under the influence of compressed air or is atomized near the spray gun. The atomization may also be realized with at least one electric field, ultrasound, high rotation or another method or with combinations of several different methods. The inlet region of the exchangeable spray medium guide unit may be connected or connectable to a material supply device. This material supply device may consist, for example, of a gravity-feed cup, a suction-feed cup or a laterally mounted cup or of a supply line that is connected or can be connected to an external material storage unit such as, e.g., a paint, varnish or adhesive container. It would also be conceivable to utilize a combination of these material supply devices. In addition, the material supply device may not only be connected to the inlet region of the exchangeable spray medium guide unit, but also to an inlet region of the base body that may be formed by the recess. In this case, the spray medium can flow into the inlet region of the exchangeable spray medium guide unit via this inlet region of the base body.

The exchangeable spray medium guide unit may be realized in the form of a disposable part that is thrown away after its use. When the spray gun needs to be used again, a new exchangeable spray medium guide unit is inserted into the recess of the spray gun. However, it would also be conceivable to remove the exchangeable spray medium guide unit from the gun after its use for cleaning purposes and to subsequently reinsert the exchangeable spray medium guide unit.

The recess is preferably arranged on the upper side of the base body, laterally on the base body or on the underside of the base body. The recess may extend over several sides, it may be arranged on several sides or it may extend from one side to at least one other side. In this way, the spray gun can be predestined for different types of material supply devices. A recess should be provided on the upper side of the base body, in particular, if the spray gun is intended for use in connection with a gravity-feed cup. A lateral recess allows the use of a laterally mounted cup and a recess on the underside of the base body is advantageous when a suction-feed cup is used. An external material supply device in the sense of a so-called tank gun can be arranged on any type of recess. If one or more recesses are provided on different sides, it is possible to align the inlet region of the exchangeable spray medium guide unit in different positions and to thusly utilize different material supply devices with the same spray gun.

The recess preferably extends from a spray medium inlet to a spray medium outlet of the base body. In this way, it is possible to convey the spray medium from a material supply device to the nozzle of the spray gun.

In a particularly preferred embodiment, the recess features at least one concave region. In this way, it is suitable for accommodating a cylindrical, conical or tapered exchangeable spray medium guide unit.

The at least one concave region is preferably open on its side that faces the spray medium outlet, [or] on its side that faces away from the spray medium outlet, toward the bottom or toward the top. It would also be conceivable to provide several open sides or oblique openings.

It is preferred that the at least one concave region at least partially has an aperture angle of less than 180°, particularly an aperture angle between 100° and 179°. In this way, the exchangeable spray medium guide unit is inserted into the recess while being subjected to a slight elastic deformation and positively held therein without applying an external force. It can be removed from the recess once again while being subjected to a slight elastic deformation if an external force is applied by a user.

The recess may be realized in such a way that the spray medium guide unit cannot be inserted into or arranged on and removed from the base body with a purely linear motion, but the insertion and removal motion rather needs to include at least one rotatory component such as, for example, a pivoting motion. This provides the advantage that the exchangeable spray medium guide unit is positively held by the base body without additional fixing means.

The recess is preferably realized in such a way that it is possible to pivot or slide the exchangeable spray medium guide unit into the recess or to arrange the exchangeable spray medium guide unit in or on the recess by means of several superimposed or successive motions.

The insertion of an exchangeable spray medium guide unit into a recess that may be situated on the upper side or on the underside of the base body or laterally thereon may take place, for example, as follows: the exchangeable spray medium guide unit is essentially moved into the vicinity of the recess coaxial to the axis of the recess (spray medium inlet axis) or parallel thereto such that the spray medium outlet of the exchangeable spray medium guide unit points forward. Once the spray medium outlet of the exchangeable spray medium guide unit is positioned approximately flush with the spray medium outlet of the base body, a pivoting motion is carried out in order to coaxially align the spray medium outlet of the exchangeable spray medium guide unit with the spray medium outlet of the base body. Subsequently, the exchangeable spray medium guide unit can be coaxially displaced or inserted in the direction of the spray medium outlet of the base body. These steps are carried out in the reverse sequence and in the opposite direction in order to remove the exchangeable spray medium guide unit.

In another embodiment of the inventive spray gun with one-piece base body, in which the recess is essentially situated laterally on the base body and extends up to its upper side and/or its underside, the insertion of the exchangeable spray medium guide unit takes place as described below: the exchangeable spray medium guide unit is pivoted in the direction of the spray medium outlet of the base body such that its spray medium outlet points forward. In this case, the spray medium inlet of the exchangeable spray medium guide unit may be inclined relative to its intended alignment. Subsequently, the inserting process may comprise a displacement or insertion of the exchangeable spray medium guide unit in the direction of the spray medium outlet of the base body, for example, until the exchangeable spray medium guide unit at least regionally abuts on a contact region of the base body or of an attachment. The inserting process may furthermore comprise a slewing motion of the exchangeable spray medium guide unit, particularly its spray medium inlet, into the intended position. When a gravity-feed cup is used, this spray medium inlet essentially points upward or obliquely upward and in one other direction. When a suction-feed cup or an external material supply device is used, the spray medium inlet of the exchangeable spray medium guide unit essentially points downward or obliquely downward and in one other direction. When using a laterally mounted cup, the exchangeable spray medium guide unit can be pivoted into position from above or below and then subjected to a slewing motion in the lateral direction. In any case, it is also possible to realize the recess in such a way that the exchangeable spray medium guide unit can be pivoted into position from another side or from any side and subsequently subjected to a slewing motion into the intended position.

The material supply device can be arranged on the exchangeable spray medium guide unit either before or after the exchangeable spray medium guide unit is inserted into the recess of the base body. In the first instance, the material supply device and the exchangeable spray medium guide unit are jointly arranged in or on the recess in the form of an assembly.

The placement of the paint needle may likewise take place before or after the exchangeable spray medium guide unit is inserted. It would be conceivable to place the paint needle into the exchangeable spray medium guide unit before it is arranged in or on the recess. Subsequently, the paint needle is separably or inseparably connected to the paint needle-actuating element by means of a coupling element. The paint needle-actuating element may either be permanently arranged in the spray gun or placed therein before or after the paint needle is inserted. It would likewise be conceivable that the paint needle is only placed into the exchangeable spray medium guide unit after the attachment thereof. This may take place in conjunction with the paint needle-actuating element if the paint needle and the paint needle-actuating element are already assembled prior to the insertion. Alternatively, the paint needle may be initially inserted into the exchangeable spray medium guide unit before the paint needle-actuating element is connected to the paint needle.

The paint needle may be arranged in the exchangeable spray medium guide unit, for example due to friction, such that it presses against and thusly closes the outlet opening of the exchangeable spray medium guide unit after the exchangeable spray medium guide unit has been removed from the recess. In this way, the exchangeable spray medium guide unit can serve as a cup cover. Other covering means can therefore be eliminated.

In addition, the process of inserting and of removing the exchangeable spray medium guide unit may in any case comprise an actuation of the trigger, for example, in order to move the paint needle-actuating element out of the path of the exchangeable spray medium guide unit.

The exchangeable spray medium guide unit is preferably held in the recess by means of a positive fit, a taper or a restraint. In this way, a first immobilization can be realized without additional means.

At least one contact region in or on the recess preferably ensures a radial and/or axial immobilization of the exchangeable spray medium guide unit in the recess. The contact region may feature, for example, a shoulder, a ring, a cone, a web, a hook and/or an eyelet that may be arranged on the exchangeable spray medium guide unit and/or on the base body. It would furthermore be possible to arrange a contact element on the exchangeable spray medium guide unit and a corresponding counter element on the base body. The contact region may also be realized integrally with the base body and comprise a sealing element or itself act as a seal and as a guide.

The base body preferably features one or more compressed air conduits that preferably extend in at least one part of the base body that does not contain a recess. In this way, compressed air can be conveyed from a compressed air connection to an air nozzle regardless of the size, shape or position of the recess.

In a particularly preferred exemplary embodiment, the exchangeable spray medium guide unit can be locked on or in the base body by means of at least one fixing element. In addition to a first immobilization, this ensures a secure retention of the exchangeable spray medium guide unit. The fixing means may feature, for example, a mechanical, magnetic, pneumatic or hydraulic element. It may comprise a nonpositive or positive connection, an integral hinge, a catch mechanism, an eccentric element or a screw mechanism.

It would furthermore be possible to fix the exchangeable spray medium guide unit in or on the base body by means of the material supply device. This may be realized, e.g., in the form of a restraint, i.e., the diameter of the spray medium inlet of the exchangeable spray medium guide unit is enlarged when the material supply device is attached, for example when respectively screwing in or on or inserting or attaching a cup, such that the outer wall of the spray medium inlet of the exchangeable spray medium guide unit is pressed against a region of the spray medium inlet of the base body.

In addition, the immobilization in or on the base body may be realized by means of a cover that is arranged or can be arranged on the base body. For this purpose, it would be possible, for example, to utilize an air distribution ring or a nozzle set that, for example, can be screwed on the base body by means of an air nozzle ring or arranged thereon otherwise. This component or these components may also be realized in the form of disposable articles that are intended for single use and manufactured of metal and/or plastic.

Magnetic elements may consist, for example, of magnets or magnetic adhesive tapes that are arranged or can be arranged on the exchangeable spray medium guide unit and/or on the base body. It would also be conceivable that the exchangeable spray medium guide unit and/or the base body themselves are realized magnetically or magnetizable or at least feature corresponding regions.

It would be conceivable that at least one pneumatic and/or hydraulic element such as, for example, a cylinder, a pneumatic muscle or an air cushion or oil cushion is arranged or can be arranged on the exchangeable spray medium guide unit and/or on the base body and locks the exchangeable spray medium guide unit on the base body upon its activation.

The at least one pneumatic element may be connected or connectable to a separate compressed air supply. This separate compressed air supply may be realized, for example, in the form of a compressor that is connected to the pneumatic element by means of an air conveying unit. A junction of the supply line may also be provided in the region of the compressed air supply or compressed air distribution or on a compressed air generator such as a compressor, wherein one supply line supplies the compressed air conduits with air and the other supply line supplies the pneumatic element with air. The individual supplies may feature common or separate means for adjusting the air volume and/or the air pressure.

The at least one pneumatic element may alternatively or additionally be connected to the same compressed air supply as the compressed air conduits in the base body. This means that compressed air flows from a compressed air connection of the spray gun into the compressed air conduits in the base body, as well as into the pneumatic element. The advantage of this embodiment can be seen in that the pneumatic element can be activated with only one compressed air connection in order to lock the exchangeable spray medium guide unit. The pneumatic element may be realized such that it can already be activated by connecting an air supply to the compressed air connection of the spray gun. The activation may furthermore be realized by actuating the trigger or by means of a separate activation mechanism.

The exchangeable spray medium guide unit and the at least one fixing means may either be realized integrally or such that the exchangeable spray medium guide unit is connected or can be connected to the at least one fixing means in a separable or inseparable fashion. The fixing means may be manufactured together with the exchangeable spray medium guide unit such as, for example, injection-molded, bonded, welded, soldered or clipped thereon, inserted therein or attached thereto, fused thereon or connected or connectable thereto otherwise.

In a particularly preferred embodiment, at least part of the paint needle extends through the exchangeable spray medium guide unit. It would be conceivable that at least one sealing means is arranged or can be arranged between the paint needle and the exchangeable spray medium guide unit in order to prevent an undesirable escape of spray medium. This at least one sealing means may be connected to the exchangeable spray medium guide unit or to the paint needle or to both. In the latter instance, the sealing means needs to be so large that a relative motion between the exchangeable spray medium guide unit and the paint needle is possible. The at least one sealing means may consist, for example, of a sealing lip that is injection-molded on the respective element, a film seal, a push-through membrane, a corrugated membrane, a bellows membrane, a ring seal or another sealing means.

The paint needle may consist of one piece or several pieces and be manufactured of a metal or a metal alloy and/or of a plastic, a plastic mixture, a plastic alloy and/or a reinforced plastic or a plastic compound. The plastic may be reinforced, for example, with glass fibers or carbon fibers, with other fibers or with particles such as nanoparticles, particularly carbon nanotubes. It would be conceivable that different regions of the paint needle consist of different materials.

The paint needle-actuating element may be separably coupled to the paint needle or permanently connected to the paint needle. The coupling may be realized, for example, by means of a gearing, a bolt coupling, a ball coupling or a prism coupling. It would also be conceivable to use combinations of different couplings.

The paint needle-actuating element and the paint needle preferably are or can be coupled or are or can be connected to one another in a rotationally rigid fashion. A rotation of the components could complicate the removal thereof or unintentionally disengage the coupling.

The exchangeable spray medium guide unit may consist of one component or several components and be manufactured of different materials. For example, the exchangeable spray medium guide unit may be composed or manufactured of different metals and/or plastics. Different regions of the one-piece exchangeable spray medium guide unit, as well as of the multipiece exchangeable spray medium guide unit, may be colored differently. For example, the region, through which the paint needle extends, may have a certain color or be transparent while the spray medium inlet region has a different color. The colors may already be applied or incorporated or produced by means of in-mold labeling during the manufacturing process, as well as thereafter. In a preferred embodiment, different materials are at least partially colored differently. For example, one plastic may have a different color than another plastic, one metal may have a different color than another metal or a metal may have a different color than a plastic.

The advantages of the one-component design can be seen, among other things, in a simple and cost-efficient manufacture and in that no assembly is required.

The exchangeable spray medium guide unit may consist of at least two components that are connected or can be connected to one another in a separable or inseparable fashion. One component may consist of a functional component that has a function other than or in addition to guiding the spray medium. Such a function may consist, for example, of locking the exchangeable spray medium guide unit in the base body or fixing a material supply device on the exchangeable spray medium guide unit. It would also be conceivable that one component is realized in the form of a disposable article and another component is intended for multiple uses. One component may consist of a harder and/or stronger material than the other component. Particularly the needle-guiding region may be at least partially or regionally harder or stronger than the spray medium inlet region or vice versa. In this way, tribological requirements and tolerance requirements or requirements with respect to the manufacturing technology can be fulfilled in a superior or simpler fashion.

The exchangeable spray medium guide unit may feature at least one nozzle that can be separably or inseparably attached. The nozzle is of decisive importance for the quality of the spray gun and of the spraying results achieved with the spray gun. This is the reason why it must fulfill the strictest requirements with respect to manufacturing tolerance and dimensional stability. It may therefore be advantageous to manufacture the nozzle separately and to subsequently attach the nozzle to another, less critical part of the exchangeable spray medium guide unit. Exchangeable nozzles furthermore make it possible to use different nozzle sizes. The nozzle preferably consists of a harder and/or stronger material than the first component of the exchangeable spray medium guide unit. In this way, it has a greater dimensional stability and is less sensitive to the application of a force. In this case, one component may also be realized in the form of a disposable article and another component may be intended for multiple uses. It would also be conceivable that the one-component exchangeable spray medium guide unit is provided or can be provided with a separate nozzle.

One component of the exchangeable spray medium guide unit may consist of an elastic material or of a material that can be deformed otherwise in order to simplify its insertion into the base body. It would be conceivable to realize at least one component of the exchangeable spray medium guide unit in an inflatable fashion. It may therefore be arranged in or on the recess, for example, before it is connected to an air supply. This air supply may consist of a separate air supply, but it would also be conceivable to inflate the inflatable, exchangeable spray medium guide unit with the air supply that also supplies the spray gun with air. It would also be conceivable to utilize a combination of the two supplies such as, for example, a separate preliminary supply that is maintained until the exchangeable spray medium guide unit can be inflated with the air flowing through the spray gun.

The exchangeable spray medium guide unit may at least consist of a first component that can be placed into the base body or arranged thereon in the region of the spray medium outlet and a second component that can be placed into the base body or arranged thereon in the region of the spray medium inlet. It is therefore possible, for example, to place one component into the base body from the front through the spray medium outlet and another component from above through the spray medium inlet. The two components may join and overlap in a certain region and be connected to one another. In this way, a form-fitting retention of the assembled exchangeable spray medium guide unit in the base body is ensured.

In an exchangeable spray medium guide unit that consists of several components, it would be conceivable that at least one sealing means is arranged or can be arranged in the connecting region of the components in order to prevent an undesirable escape of spray medium.

In a preferred embodiment of the spray gun with one-piece base body, the exchangeable spray medium guide unit features at least one element for being connected to a material supply device. In this way, the material supply device can be directly attached to the exchangeable spray medium guide unit. The connection to the base body can be eliminated. The element may feature at least one catch mechanism, at least one connecting rail, at least one thread or at least one thread segment. It would alternatively or additionally also be conceivable that the exchangeable spray medium guide unit can be bonded, soldered, welded or attached to the material supply device or inserted therein.

The exchangeable spray medium guide unit may be connected to and locked on the material supply device. However, it may also be fixed on the base body and only indirectly connected to the material supply device.

At least one sealing means such as, for example, a ring seal may be arranged between the exchangeable spray medium guide unit and the material supply device. However, the seal may also be produced by the material supply device and/or the exchangeable spray medium guide unit, for example, if at least one of the two devices is manufactured of a softer material or the two devices are connected to one another, for example, by means of the thread.

The exchangeable spray medium guide unit and the material supply device may be realized integrally. This is particularly advantageous if the exchangeable spray medium guide unit and the material supply device such as, for example, a cup are realized in the form of disposable articles intended for single use.

If the exchangeable spray medium guide unit consists of several components, it would be conceivable that one component of the exchangeable spray medium guide unit is connected or can be connected to the material supply device in a separable or inseparable fashion. The other component of the exchangeable spray medium guide unit may in turn be connected or connectable to this connection.

The exchangeable spray medium guide unit may be manufactured of a metal or a metal alloy and/or of a plastic, a plastic mixture, a plastic alloy and/or a reinforced plastic or a plastic compound. The plastic may also be reinforced in this case, for example, with glass fibers or carbon fibers, with other fibers or with spherical or differently shaped particles such as nanoparticles, particularly carbon nanotubes. Other reinforcements or stabilizing options may also be considered.

The exchangeable spray medium guide unit preferably extends beyond the recess in the region of the spray medium outlet of the base body. In this way, contact between the spray medium and the recess can be avoided such that no cleaning of the recess is required.

The exchangeable spray medium guide unit may alternatively end before the recess or flush therewith in the region of the spray medium outlet of the base body.

The exchangeable spray medium guide unit may also extend beyond the recess in the region of the spray medium inlet of the base body. In this way, the connection of the exchangeable spray medium guide unit to a material supply device can be simplified.

However, the exchangeable spray medium guide unit may also end before the recess or flush therewith in the region of the spray medium inlet of the base body. Consequently, only part of the recess needs to be cleaned after the contact with a spray medium.

The recess may be designed for accommodating exchangeable spray medium guide units of different sizes.

In a particularly preferred embodiment of the spray gun with one-piece base body, at least one sealing means is arranged or can be arranged between the exchangeable spray medium guide unit and the base body. In this way, an undesirable material flow and/or air flow can be prevented and a firm seat of the exchangeable spray medium guide unit in the recess can be ensured. The at least one sealing means may be permanently or separably arranged on the exchangeable spray medium guide unit or on the base body. In both instances, the at least one sealing means may be injection-molded or bonded on the respective component. It would alternatively or additionally also be conceivable to loosely insert at least one sealing means into at least one region of the recess.

The paint needle of a particularly advantageous spray gun with one-piece base body is equipped with at least one pull-back spring or actuating spring that preferably extends within the exchangeable spray medium guide unit. The spring may be braced against a stopper that is provided on the paint needle and integrally molded thereon.

The spring may be arranged between the stopper and a coupling element.

The stopper may be realized, for example, in the form of a cone or in the form of a disk and arranged inside or outside the exchangeable spray medium guide unit.

The inventive method for arranging an exchangeable spray medium guide unit in or on a spray gun with one-piece base body may include at least one rotatory motion. It may consist, for example, of a turning motion, a tilting motion or a pivoting motion. Combinations of these motion types may also be considered.

A particularly preferred method for arranging an exchangeable spray medium guide unit in or on a spray gun with one-piece base body comprises at least the following steps: the exchangeable spray medium guide unit is essentially moved into the vicinity of the recess coaxial to the axis of the recess (spray medium inlet axis) or parallel thereto such that the spray medium outlet of the exchangeable spray medium guide unit points forward. Once the spray medium outlet of the exchangeable spray medium guide unit is positioned approximately flush with the spray medium outlet of the base body, a pivoting motion is carried out in order to coaxially align the spray medium outlet of the exchangeable spray medium guide unit with the spray medium outlet of the base body.

The exchangeable spray medium guide unit may also be pivoted in the direction of the spray medium outlet of the base body such that its spray medium outlet points forward.

In an exemplary embodiment of the inventive method, the spray medium inlet of the exchangeable spray medium guide unit may during the arrangement thereof be at least temporarily inclined relative to its intended alignment.

The exchangeable spray medium guide unit may be coaxially displaced or inserted in the direction of the spray medium outlet of the base body.

The exchangeable spray medium guide unit, particularly its spray medium inlet, is preferably moved into the intended position with a slewing motion. The exchangeable spray medium guide unit may also be moved into an intended position with a different motion such as, for example, a rotation.

The method for removing the exchangeable spray medium guide unit from or out of the spray gun with one-piece base body may include at least one rotatory motion. This motion may consist, for example, of a turning motion, a tilting motion or a pivoting motion. Combinations of these motion types may also be considered. The exchangeable spray medium guide unit may be frequently subjected to an unintentional linear motion such that the exchangeable spray medium guide unit inadvertently disengages from or out of the spray gun with one-piece base body. The risk of an unintentional removal of the exchangeable spray medium guide unit from or out of the spray gun with one-piece base body is reduced due to the required rotatory component.

The method for removing an exchangeable spray medium guide unit from or out of a spray gun with one-piece base body preferably comprises at least the following steps: the exchangeable spray medium guide unit is pivoted until the spray medium outlet of the exchangeable spray medium guide unit is positioned coaxial to the spray medium inlet axis of the recess or parallel thereto. Subsequently, the exchangeable spray medium guide unit is removed from or out of the recess essentially coaxial to the spray medium inlet axis of the recess or parallel thereto.

During the removal of the exchangeable spray medium guide unit from or out of the spray gun with one-piece base body, the spray medium inlet of the exchangeable spray medium guide unit may be at least temporarily inclined relative to its intended alignment.

The exchangeable spray medium guide unit may be coaxially displaced or pushed or pulled away from the direction of the spray medium outlet of the base body. The exchangeable spray medium guide unit, particularly its spray medium inlet, is preferably moved out of the intended position by means of a slewing motion.

BRIEF DESCRIPTION OF THE DRAWINGS

Individual exemplary embodiments of the spray gun with one-piece base body are described in greater detail below with reference to 10 drawings. In these drawings.

DETAILED DESCRIPTION

Figure 1:
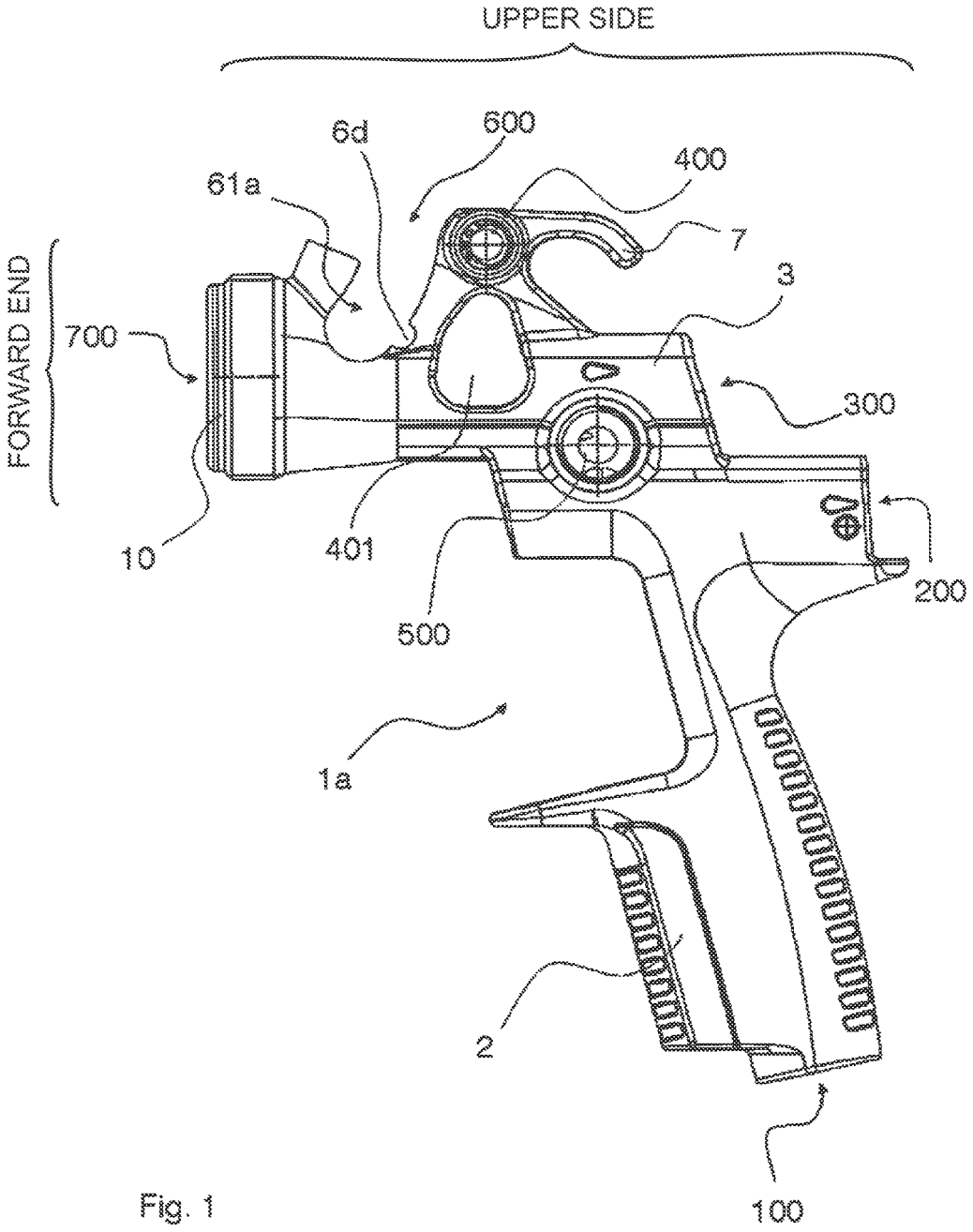
FIG. 1 shows a side view of the with one-piece base body base body of a first exemplary embodiment of an inventive spray gun.
Figure 2:
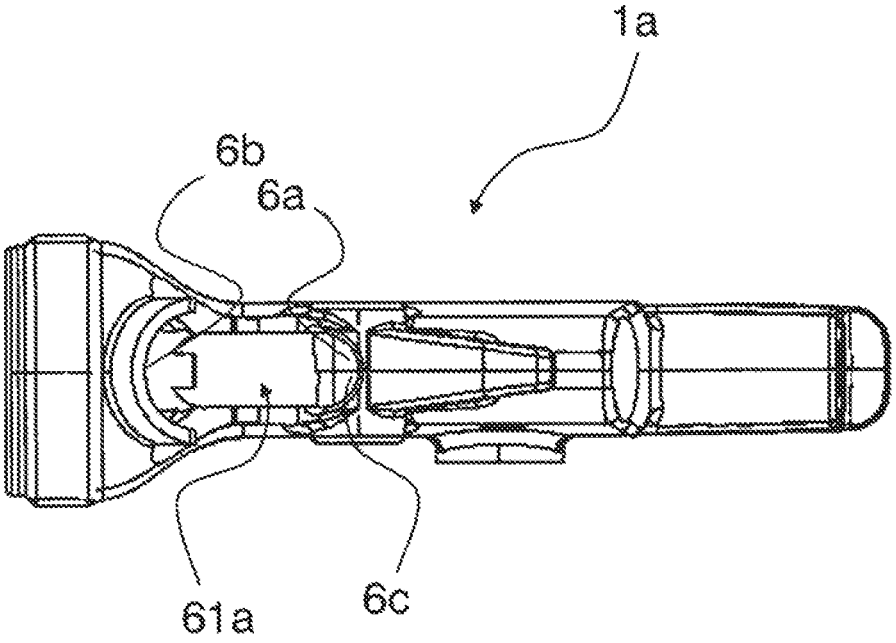
FIG. 2 shows a top view of the base body of the first exemplary embodiment of an inventive spray gun with one-piece base body.

FIGS. 1 and 2 show a one-piece base body 1*a* of an inventive spray gun that features a handle region 2 and a head region 3. These two regions 2 and 3 conventionally extend at an angle of approximately 104 degrees to one another. The base body 1*a* features several openings for different attachments that are not illustrated in FIGS. 1 and 2 such as, for example, an opening 100 for a compressed air connection, an opening 200 for an air micrometer, an opening 300 for a material volume control, openings 400, 401 for a trigger and an opening 500 for a circular/broad jet control. The base body 1*a* furthermore features a suspension hook 7, a spray medium inlet region 600, a spray medium outlet region 700 and a thread 10 for attaching an air nozzle ring.

In the embodiment illustrated in FIGS. 1 and 2, the recess 61*a* is situated on the upper side of the base body 1*a* in the region of the spray medium inlet 600 of the base body 1*a*. An exchangeable spray medium guide unit can be inserted into the base body 1*a* of the spray gun through this recess 61*a* from the upper rear by means of a pivoting motion. The rear boundary of the recess 61*a* is formed by a concave wall section 6*a* of the spray medium inlet region 600 that extends in the region of the openings 400, 401 for a trigger 40 that is not illustrated in these figures. On the other hand, the front boundary of the recess 61*a* is formed by a concave wall section 6*b* of the spray medium inlet region 600 that extends in the region of the beginning of the thread 10 for attaching an air nozzle ring. The bottom boundary of the recess 61*a* is formed by the bottom section 6*c* of the spray gun base body 1*a*. The recess 61*a* may also feature lateral boundaries that are formed by wall sections of the spray gun base body 1*a*. Alternatively, a lateral boundary can be at least partially eliminated. In contrast to a conventional spray medium inlet region, a U-shaped area is cut out of the spray medium inlet region in the embodiment illustrated in FIG. 1. The recess 61*a* is in comparison with a conventional spray medium inlet region widened toward the front in the direction of the spray medium outlet and/or toward the rear in order to allow the insertion and removal of the exchangeable spray medium guide unit. In the region of the recess 61*a*, the base body 1*a* features a groove 6*d* that serves for fixing the exchangeable spray medium guide unit.

Figure 3:
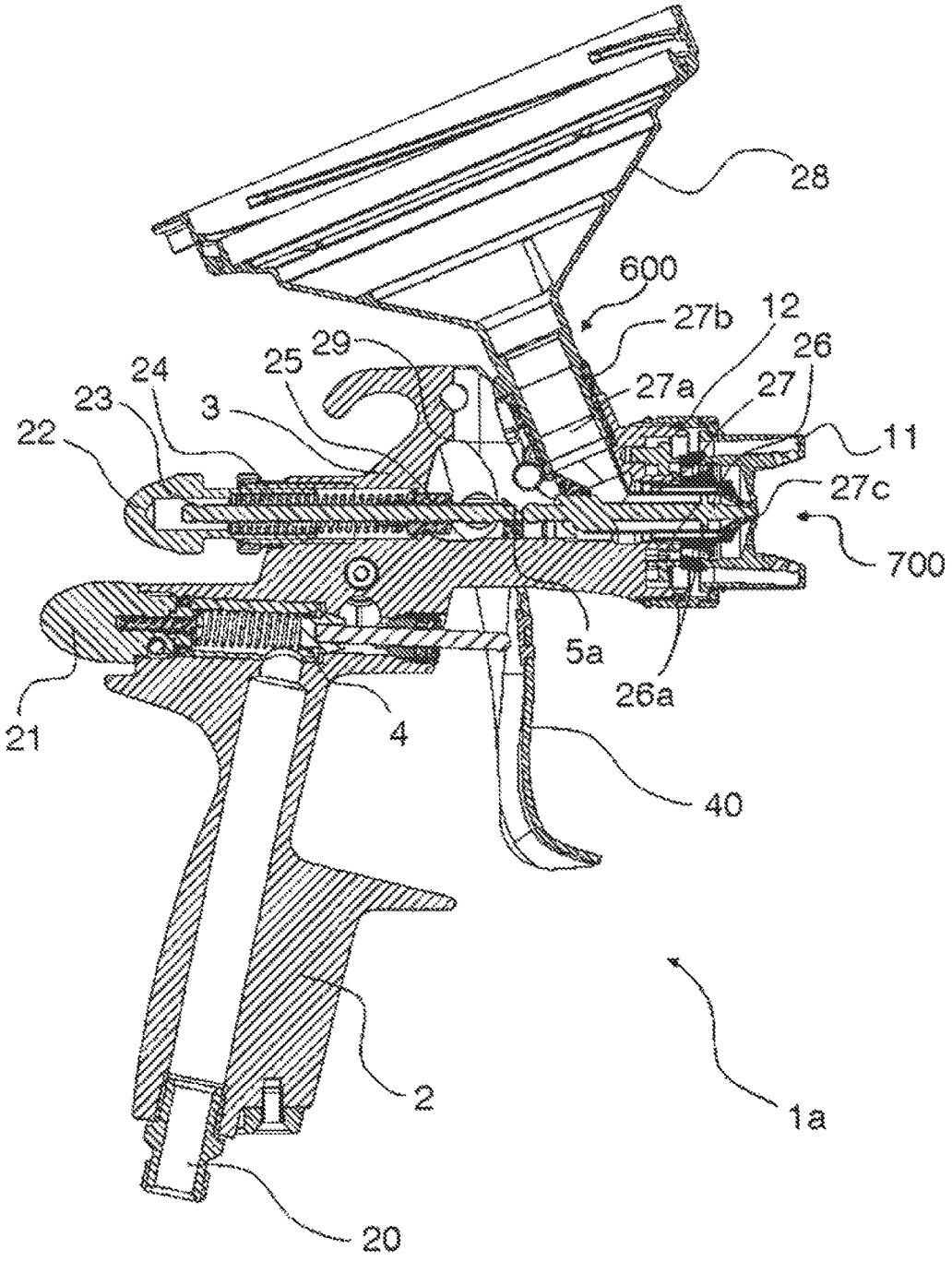
FIG. 3 shows a sectioned side view of the first exemplary embodiment of an inventive spray gun with one-piece base body including attachments and cup.

FIG. 3 shows a sectioned side view of the first embodiment of the inventive spray gun with one-piece base body including attachments.

The base body 1*a* features a compressed air connection 20 on its lower end. Several air conduits that are not illustrated in their entirety extend from the compressed air connection 20 through the handle region 2 and through the head 3 and end at the spray medium outlet region 700 of the spray gun head 3. The volume and the pressure of the air flowing through these air conduits can be conventionally adjusted by means of an air micrometer 21. The spray medium outlet region 700 of the head 3 is equipped with an air nozzle 11 that features protruding horns with openings. The spray gun is furthermore equipped with an air nozzle ring 12.

An exchangeable spray medium guide unit 27 is inserted into the recess 61*a* and extends beyond the recess 61*a* in the region of the spray medium inlet 600 and in the region of the spray medium outlet 700 of the base body 1*a*. The outlet region 27*c* of the exchangeable spray medium guide unit 27 essentially extends up to the outer end of the outlet of the air nozzle 11. The exchangeable spray medium guide unit 27 is pressed against the front wall section 6*b* with the aid of a fixing means 29 and thusly locked in position. In the exemplary embodiment shown, essentially the entire upper front region of the recess serves as contact region for the exchangeable spray medium guide unit 27. In this way, a firm seat of the exchangeable spray medium guide unit 27 in the base body 1*a* is ensured.

The paint needle 26 is arranged within the exchangeable spray medium guide unit 27 and guided therein by means of webs 26*a*. When the trigger 40 is not actuated, the outlet region 27*c* of the exchangeable spray medium guide unit 27 is closed by the paint needle 26.

In the present exemplary embodiment, the spray medium guide unit 27 features a thread 27*a* for screwing in or screwing on a material supply device 28, namely a gravity-feed cup 28 that is only schematically indicated in FIG. 3. After the gravity-feed cup 28 filled with a spray medium has been screwed in or screwed on the exchangeable spray medium guide unit 27, the spray medium flows from the gravity-feed cup 28 into the inlet region 27*b* of the exchangeable spray medium guide unit 27, in which it remains as long as the outlet region 27*c* of the exchangeable spray medium guide unit 27, which in this case is realized in the form of a nozzle, is closed by the paint needle 26.

The air valve 4 is opened when the trigger 40 is actuated up to a first pressure point. This causes compressed air to be conveyed to the air nozzle 11 through the compressed air conduits. When the trigger 40 is additionally pulled back, the paint needle-actuating element 23 is moved and retracts the paint needle 26 from the outlet region 27*c* of the exchangeable spray medium guide unit 27 by means of a coupling element 5*a*. At this point, the spray medium can exit the exchangeable spray medium guide unit 27 and be atomized by the compressed air being discharged from the air nozzle 11.

A spring 24 with a stopper 25 is regionally arranged around the paint needle-actuating element 23 and presses the paint needle 26 into the outlet of the air nozzle 11 when the trigger 40 is not actuated in order to close the outlet.

Figure 4:
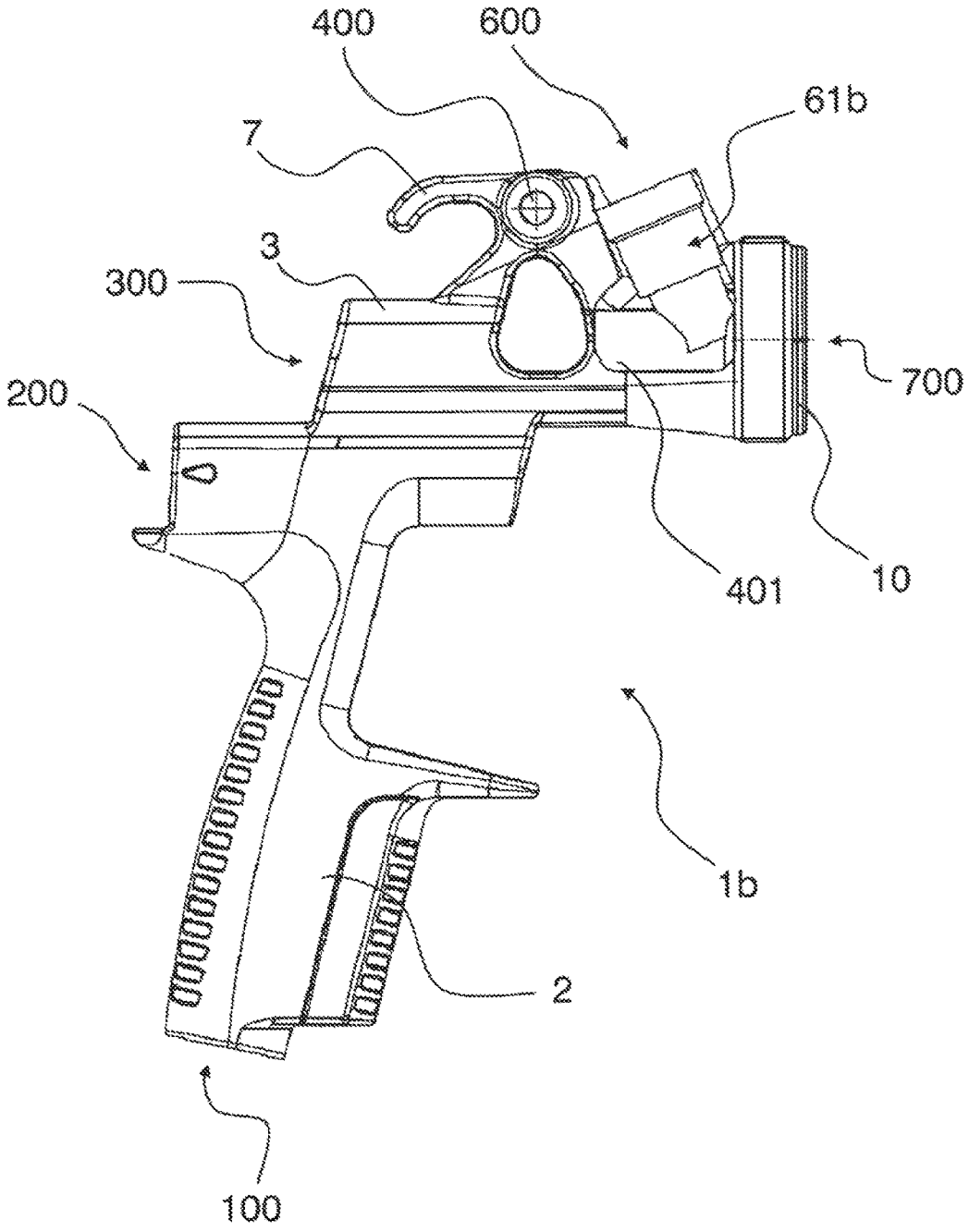
FIG. 4 shows a side view of the with one-piece base body base body of a second exemplary embodiment of an inventive spray gun.
Figure 5:
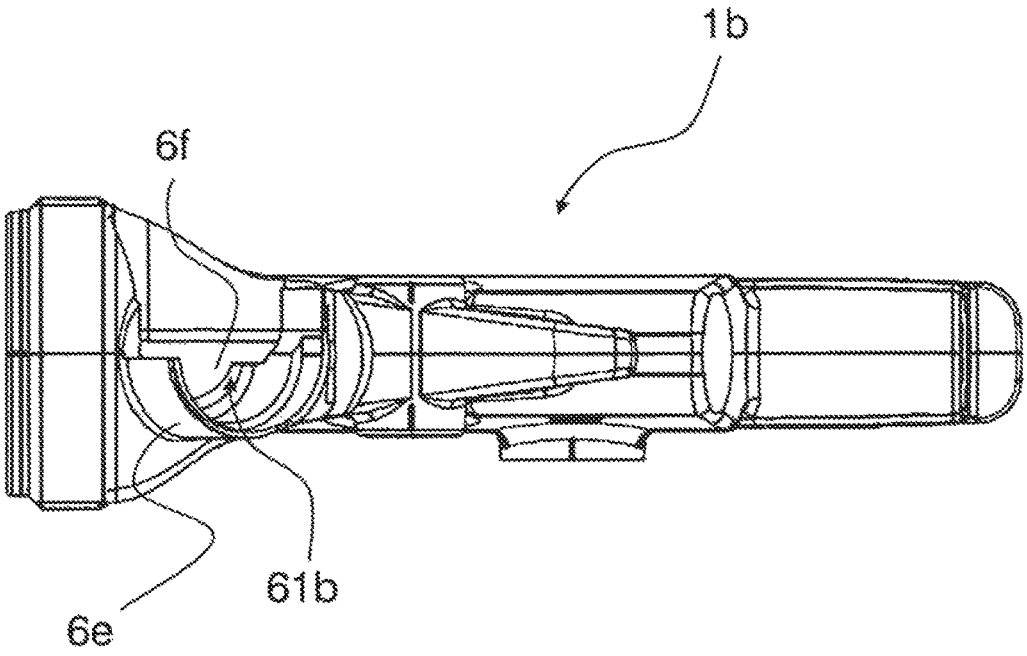
FIG. 5 shows a top view of the with one-piece base body base body of the second exemplary embodiment of an inventive spray gun.
Figure 6:
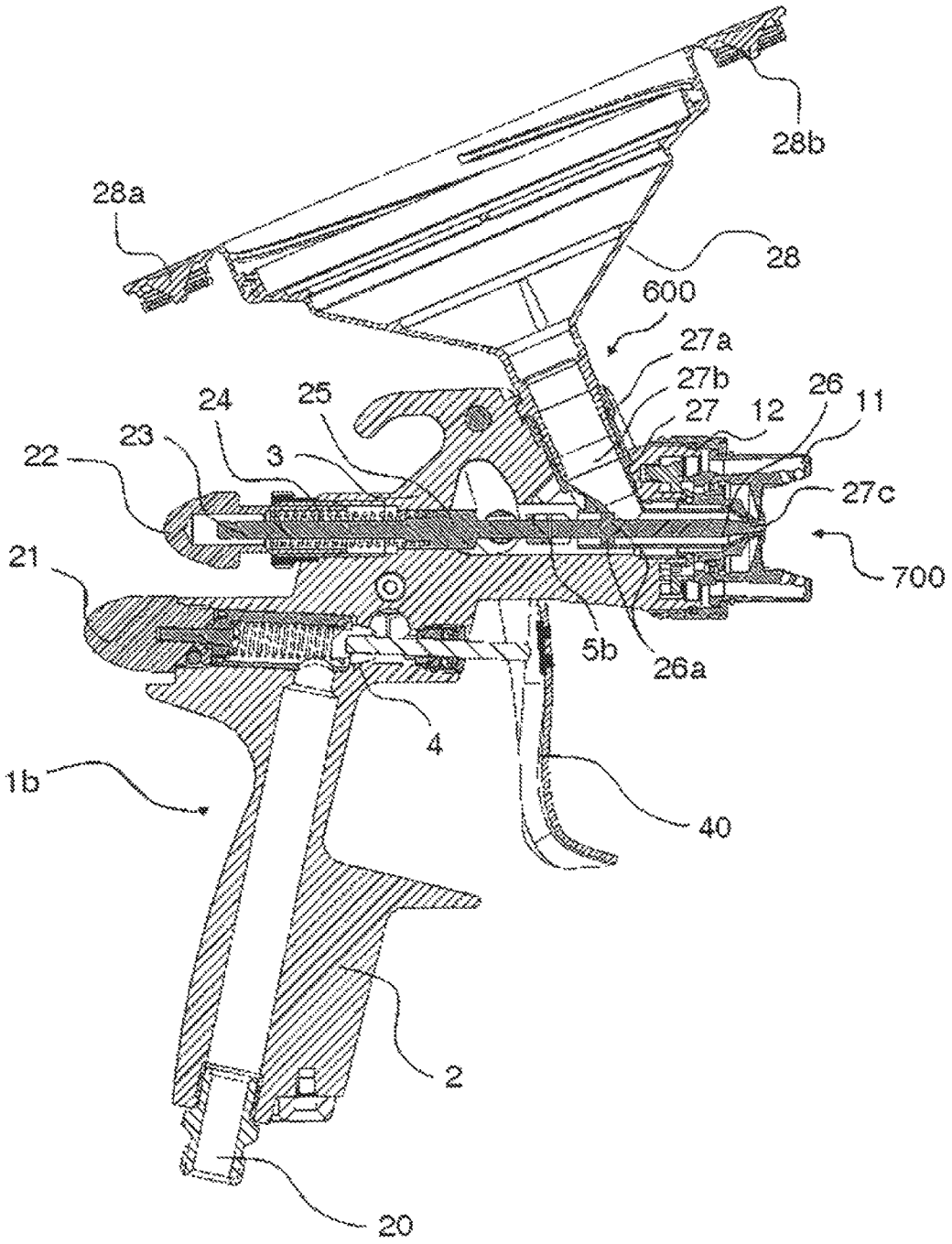
FIG. 6 shows a sectioned side view of the second exemplary embodiment of an inventive spray gun including attachments and cup.

FIGS. 4 to 6 show another embodiment of an inventive spray gun with one-piece base body. FIGS. 4 and 5 respectively show only the base body 1*b* while FIG. 6 shows the spray gun including attachments and cup.

The base body of the second exemplary embodiment features a handle region 2 and a head 3 and is realized similar to the base body of the first exemplary embodiment. The base body 1*b* features openings for not-shown attachments such as, among other things, an opening 100 for a compressed air connection 20, an opening 200 for an air micrometer 21, an opening 300 for a material volume control 22, openings 400, 401 for a trigger 40 and an opening 500 for a circular/broad jet control that is not visible in FIG. 4. The base body 1*b* furthermore features a suspension hook 7, a spray medium inlet region 600, a spray medium outlet region 700 and a thread 10 for attaching an air nozzle ring.

In the present exemplary embodiment, the base body 1*b* features a recess 61*b* with an inlet region 600 and an outlet region 700 that is suitable for accommodating an exchangeable spray medium guide unit. In the embodiment illustrated in FIGS. 4 to 6, the recess 61*b* is essentially arranged laterally on the base body 1*b* and extends up to the upper side of the base body 1*b*. In comparison with a conventional spray gun, a lateral region of the head 3 is partially removed. The boundaries of the recess are formed by a lateral section 6*e* and a bottom section 6*f*. In the embodiment illustrated in FIG. 5, the partially opened concave lateral section 6*e* has an aperture angle of approximately 180°. However, the aperture angle is preferably smaller and lies, in particular, between 100° and 179°. In this way, the recess is suitable for accommodating a cylindrical exchangeable spray medium guide unit. An aperture angle of less than 180° makes it possible to positively arrange the exchangeable spray medium guide unit in the recess.

FIG. 6 shows a sectioned side view of the second embodiment of the inventive spray gun with one-piece base body including attachments.

Similar to the first exemplary embodiment, the base body 1*b* in this embodiment features a compressed air connection 20 on its lower end. Several air conduits that are not illustrated in their entirety also extend from the compressed air connection 20 through the handle region 2 and the head 3 and end at the spray medium outlet region 700 of the spray gun head 3 in this case. In addition, this exemplary embodiment also features an air micrometer 21, an air nozzle 11 with protruding horns that contain openings and an air nozzle ring 12.

An exchangeable spray medium guide unit 27 is inserted into the recess 61*b* and extends beyond the recess 61*b* in the region of the spray medium inlet 600 and in the region of the spray medium outlet 700 of the base body 1*b*. The outlet region 27*c* of the exchangeable spray medium guide unit 27 essentially extends up to the outer end of the outlet of the air nozzle 11. The exchangeable spray medium guide unit 27 is held by a not-shown fixing means. This fixing means preferably consists of an integral hinge, one end of which is permanently connected to the exchangeable spray medium guide unit 27, preferably injection-molded thereon, and the other end of which can be separably connected to the base body 1*b*, preferably by means of a plug connection or clip connection. In the exemplary embodiment shown, essentially one entire lateral half of the recess serves as the contact region for the exchangeable spray medium guide unit 27. In this way, a firm seat of the exchangeable spray medium guide unit 27 in the base body 1*b* is ensured.

The paint needle 26 is arranged within the exchangeable spray medium guide unit 27 and guided therein by means of webs 26*a* as in the first exemplary embodiment. When the trigger 40 is not actuated, the outlet region 27*c* of the exchangeable spray medium guide unit 27 is closed by the paint needle 26.

As in the first exemplary embodiment, the spray medium guide unit 27 in the present exemplary embodiment also features a thread 27*a* for screwing in or screwing on a material supply device 28, namely a gravity-feed cup 28 that is only schematically indicated in FIG. 6. After the gravity-feed cup 28 filled with a spray medium has been screwed in or screwed on the exchangeable spray medium guide unit 27, the spray medium flows from the gravity-feed cup 28 into the inlet region 27*b* of the exchangeable spray medium guide unit 27, in which it remains as long as the outlet region 27*c* of the exchangeable spray medium guide unit 27, which in this case is realized in the form of a nozzle, is closed by the paint needle 26.

The air valve 4 is opened when the trigger 40 is actuated up to a first pressure point. This causes compressed air to be conveyed to the air nozzle 11 through the compressed air conduits. When the trigger 40 is additionally pulled back, the paint needle-actuating element 23 is moved and retracts the paint needle 26 from the outlet region 27*c* of the exchangeable spray medium guide unit 27 by means of a coupling element 5*b*. At this point, the spray medium can exit the exchangeable spray medium guide unit 27 and be atomized by the compressed air being discharged from the air nozzle 11.

A spring 24 with a stopper 25 is regionally arranged around the paint needle-actuating element 23 and presses the paint needle 26 into the outlet of the air nozzle 11 when the trigger 40 is not actuated in order to close the outlet.

Sealing elements 28*a* and 28*b* are arranged on the cup 28 schematically indicated in FIG. 6 by means of predetermined breaking points. If the cup is not completely empty after its use, such an element can be broken off the cup and placed on the outlet region thereof in order to seal this outlet region. In this way, the spray medium situated in the cup can be preserved for subsequent use.

The sealing elements 28*a* and 28*b* can be eliminated if the exchangeable spray medium guide unit 27 can be sealed by the paint needle 26, wherein the paint needle 26 may be held in the outlet region 27*c* of the exchangeable spray medium guide unit 27, for example, by means of friction.

Figure 7:
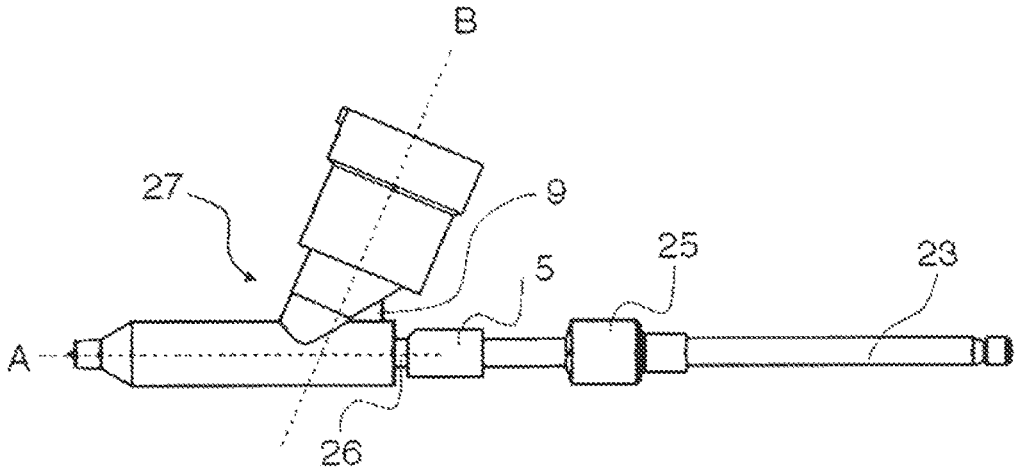
FIGS. 7 to 10 show different exchangeable spray medium guide units that are suitable for use in different embodiments of the spray gun with one-piece base body and feature different coupling elements between the paint needle and the paint needle-actuating element.

FIG. 7 shows a simple example of an exchangeable spray medium guide unit 27 without details regarding the fixing means and the coupling element. It essentially has a biaxial design and consists at least of several assembled cylinders, cylinder sections and cones. A component of the exchangeable spray medium guide unit 27 that extends along an axis A is penetrated by the paint needle 26. This component essentially consists of an elongated cylinder, an additional cylinder that has a smaller diameter and a smaller length than the nozzle and may also be realized in the form of a cone and a cone that is arranged between the two cylinders and forms the transition between the two cylinders. Two additional cylinders are arranged along an axis B that preferably intersects the axis A at an angle of approximately 110° and have diameters that are similar to one another, but larger than the diameters of the cylinders on the axis A. The larger of the two cylinders preferably features a thread for screwing in a cup. The thinner cylinder corresponds to a threadless connection of the cup and serves for the additional guidance thereof. It would naturally also be possible to utilize all other types of connections. The cylinders arranged along the axes A and B are connected by means of at least one asymmetric cone in such a way that a spray medium can flow from a cup into the cylinders arranged along the axis A through the cylinders arranged along the axis B with the least interference possible. In order to mechanically support the transition region between the axes A and B, a support element 9 in the form of a small triangular plate is arranged in the small angle between the axes.

The paint needle 26 is preferably connected to the paint needle-actuating element 23 in a separable fashion by means of a coupling element 5. The paint needle-actuating element 23 features a stopper 25, wherein a spring 24 that is not illustrated in FIGS. 7 to 10 is braced against said stopper.

The exchangeable spray medium guide unit 27 may naturally also consist of a greater or smaller number of cylinders and cones and of different shapes and combinations that may transform into one another, for example, in a stepped or smooth fashion. The mechanical support may also be realized differently and be arranged on a different side.

Such a simple exchangeable spray medium guide unit 27 can be fixed in the base body, for example, by means of an integral hinge. One end of this integral hinge is permanently connected to the exchangeable spray medium guide unit 27, preferably injection-molded thereon, and its other end can be separably connected to the base body 1*b*, preferably by means of a plug connection or clip connection.

Figure 8:
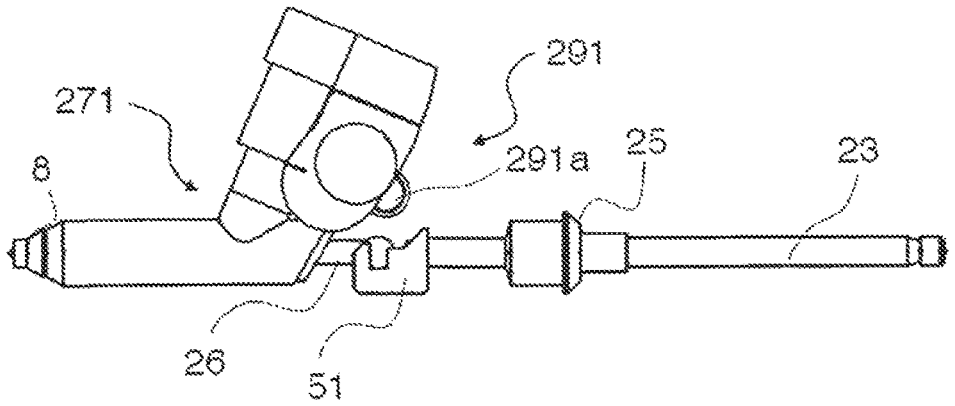
Figure 9:
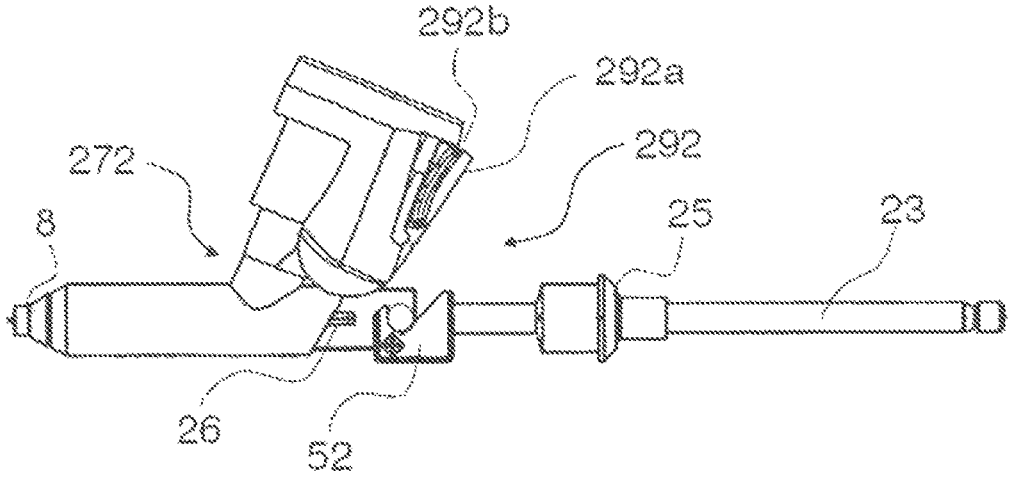
Figure 10:
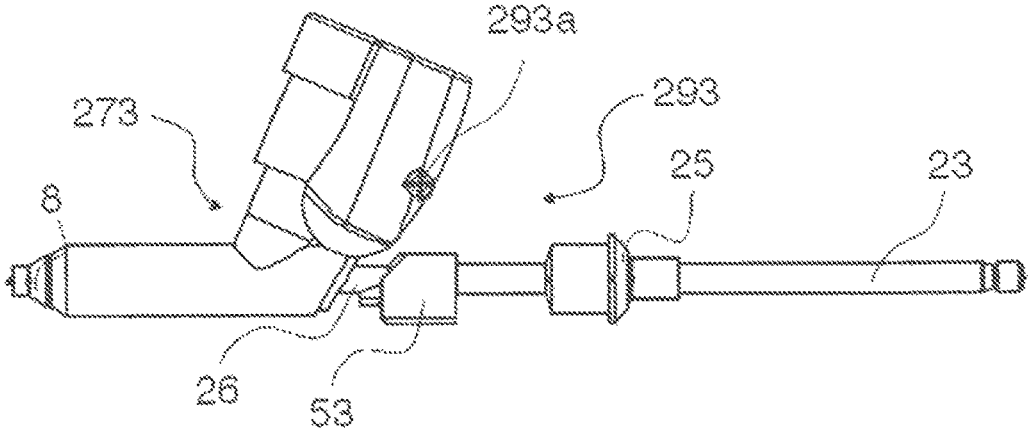

FIGS. 8 to 10 show enhancements of the embodiment illustrated in FIG. 7 that are based on this basic shape of an exchangeable spray medium guide unit.

The exemplary embodiments illustrated in FIGS. 8 to 10 feature an attached nozzle 8 that can be arranged on the exchangeable spray medium guide unit. For example, the nozzle 8 may be attached to or inserted into the original nozzle, bonded thereto or arranged thereon otherwise, but it may also be attached to or arranged on an exchangeable spray medium guide unit that originally did not feature a nozzle.

In the arrangement illustrated in FIG. 8, the coupling element between the paint needle 26 and the paint needle-actuating element 23 is realized in the form of a ball coupling 51. One of the two elements to be coupled features a ball that can be inserted into a corresponding counterelement in such a way that the two elements are positively connected in at least one direction. The counterelement is opened in that at least one other direction in order to allow a simple disengagement of the coupling. The fixing element 291 of the exchangeable spray medium guide unit features a counterelement 291*a* for engaging into the groove 6*d* illustrated in FIG. 1. When the exchangeable spray medium guide unit 271 is inserted into the recess 61*a* of the base body 1*a* of a spray gun, this counterelement 291*a* snaps into the groove 6*d* and positively fixes the exchangeable spray medium guide unit 271 in the base body 1*a*. For the removal, flexible regions of the fixing element are compressed such that the counterelements 291*a* are inwardly pressed out of the groove 6*d* and release the exchangeable spray medium guide unit 271. The exchangeable spray medium guide unit can then be pulled out of the recess 61*a*. The counterelement 291*a* and the groove 6*d* may naturally also be realized differently such as, for example, in the form of a hook and eyelet and arranged at different locations of the recess 61*a* and the exchangeable spray medium guide unit 271. The base body 1*b* illustrated in FIGS. 1 to 3 may also feature a groove for accommodating the exchangeable spray medium guide unit 271.

The coupling element in FIG. 9 consists of a bolt coupling 52. Two bolts laterally protrude from one element to be coupled and can engage into a corresponding receptacle on the other elements to be coupled. The fixing means 292 of the exchangeable spray medium guide unit 272 features a catch mechanism 292*a*. This catch mechanism consists of an elastic region, the outer edge of which is under the influence of a force situated flush with the outer edge of the exchangeable spray medium guide unit 272. A step 292*b* is formed when the elastic region is not actuated. The elastic region is pressed inward when the exchangeable spray medium guide unit 272 is inserted into the recess. The recess is realized in such a way that the elastic region springs back into its original position after the complete insertion and a step of the base body abuts on the step 292*b* in order to thusly fix the exchangeable spray medium guide unit 272. The elastic region is provided with two tabs that can be pressed inward in order to remove the exchangeable spray medium guide unit 272 from the recess. Other catch mechanisms and removal mechanisms may also be considered.

Another option for coupling the paint needle 26 to the paint needle-actuating element 23 is schematically illustrated in FIG. 10. In this case, the connection is realized in the form of a prism coupling 53. The first half of the coupling element consists of a prism that can be inserted into a corresponding counterelement from above. The exchangeable spray medium guide unit 273 features a fixing means 293 with an eccentric element 293*a*. The eccentric element 293*a* can be turned by means of a lever that is not visible in FIG. 10. During the insertion of the exchangeable spray medium guide unit 273 into the recess, the lever is situated in a position in which the narrow side of the eccentric element 293*a* points outward. After the insertion, the lever is turned such that the broad side of the eccentric element 293*a* points upward and clamps the exchangeable spray medium guide unit 273 in the recess.

The fixing element may naturally also be realized differently such as, for example, with a slide that tensions the exchangeable spray medium guide unit when it is inserted into slots on the fixing element. Combinations of different fixing elements may also be considered.

Essentially identical components, particularly the paint needle-actuating element 23 and the stopper 25, are identified by the same reference symbols in FIGS. 7 to 10.

In conclusion, it should be noted that the described exemplary embodiments merely represent a limited selection of potential embodiments and therefore do not restrict the present invention in any way.

The invention claimed is:

1. A spray gun usable with a material supply device, the spray gun having a spray medium outlet, and further comprising:

a body including a recess proximate the spray medium outlet, the recess located on an upper side of the body, the recess forming an opening that does not face a spraying direction at a forward end of the body;

a trigger;

a paint needle-actuating element that is separate from the trigger and is coupled to the trigger, the paint needle-actuating element positioned within the body to form a part of the body;

an exchangeable paint medium guide unit sized and dimensioned to be inserted into the body recess through the opening in the body;

a paint needle that is moveably contained within the guide unit to form a part of the guide unit;

the needle-actuating element moveable along a longitudinal axis of the paint needle-actuating element that is at least one of parallel and coaxial to an axis of movement of the needle, the paint needle-actuating element releaseably connected to the paint needle by a coupling formed between an end of the paint needle and an end of the paint needle-actuating element, the coupling formed from a receptacle on one of the paint needle-actuating element and needle, and a ball on the other of the paint needle-actuating element and needle.

2. The spray gun according to claim 1, wherein the recess is situated on an upper side of the base body.

3. The spray gun according to claim 2, wherein the recess extends from a spray medium inlet to the spray medium outlet of the base body.

4. The spray gun according to claim 3, wherein the recess is at least partially opened on a side that faces away from the spray medium outlet.

5. The spray gun according to claim 1, wherein the recess includes first and second concave walls which extend less than 180° around the recess, preferably between 100° and 179° around the recess.

6. The spray gun according to claim 1, wherein the recess is configured and dimensioned such that the exchangeable spray medium guide unit can be arranged in or on the recess by a positive fit, a taper or a restraint.

7. The spray gun according to claim 1, wherein the exchangeable spray medium guide unit can be radially or axially fixed in or on the recess by at least one contact region or of at least one element.

8. The spray gun according to claim 7, wherein the at least one element features a shoulder, a ring, a cone, a web, a hook and/or an eyelet.

9. The spray gun according to claim 8, wherein the at least one element is arranged on the exchangeable spray medium guide unit or on the base body.

10. The spray gun according to claim 9, wherein the at least one element is arranged on the exchangeable spray medium guide unit and a counter element is arranged on the base body.

11. The spray gun according to claim 1, wherein the base body has one or more compressed air conduits which extend in at least one part of the base body spaced a distance from the recess.

12. The spray gun according to claim 1, wherein the exchangeable spray medium guide unit can be locked on or in the base body with the aid of at least one fixing means.

13. The spray gun according to claim 12, wherein the at least one fixing means includes a catch mechanism.

14. The spray gun according to claim 1, wherein a nozzle is arranged or can be arranged on the exchangeable spray medium guide unit in a separable or inseparable fashion.

15. The spray gun according to claim 1, wherein the exchangeable spray medium guide unit includes a first component that can be placed into the base body or arranged thereon in the region of the spray medium outlet, and a second component that can be placed into the base body or arranged thereon in the region of the spray medium inlet.

16. The spray gun according to claim 1, wherein at least one sealing means is arranged or can be arranged in a connecting region of the exchangeable spray medium guide unit.

17. The spray gun according to claim 1, wherein the exchangeable spray medium guide unit extends beyond the recess in the region of the spray medium outlet or in the region of the spray medium inlet of the base body.

18. The spray gun according to claim 1, wherein the exchangeable spray medium guide unit ends before the recess or flush therewith in the region of the spray medium outlet or in the region of the spray medium inlet of the base body.

19. A material supply device, wherein the material supply device is attachable to a spray gun according to claim 1 and/or to an exchangeable spray medium guide unit arrangeable in or on the spray gun.

20. The spray gun of claim 1, the paint needle pressable against the spray medium outlet when the exchangeable spray medium guide unit is connected to the material supply device and not inserted into the spray gun, to thereby close the material supply device.

21. The spray gun of claim 1, wherein the spray gun includes a spring and a stopper connected to the paint needle-actuating element, the spring and the stopper configured to move the paint needle-actuating element to thereby press the paint needle into an outlet of an air nozzle when the trigger is not actuated.

22. A spray gun usable with a material supply device, the spray gun having a spray medium outlet and further comprising:

- a base spray gun body including a recess proximate the spray medium outlet;
- a trigger;
- a paint needle-actuating element that is separate from the trigger and is connected to form part of the body and is movable within the body along a longitudinal axis of the paint needle-actuating element, the longitudinal axis being at least one of parallel and coaxial to an axis of movement of the needle, in response to movement of the trigger;
- a removable spray medium guide unit having an inlet region which is connectable to the material supply device, a portion of the guide unit sized and dimensioned to be removably insertable into the spray gun body recess along a direction of insertion;
- a paint needle disposed within and forming a part of the removable spray medium guide unit; and
- a paint needle coupling having a first portion connected to the paint needle and a second portion connected to the paint needle-actuating element, one of the first and second portions having a receptacle opening facing the direction of insertion into which one of a ball or a prism shape of the other of the first and second portions is inserted during movement of the spray medium guide unit into the spray gun body, the first and second portions thereby mateably connectable to releasably couple and decouple the paint needle and the paint needle-actuating element, without a requirement of opening the base spray gun body.

23. The spray gun of claim 22, wherein the recess forms a curved non-linear path, and the guide unit has a curved non-linear shape conforming to the curved non-linear path.

24. The spray gun of claim 22, wherein the guide unit includes an elastically deformable catch surface, and the recess includes a surface mateable with the catch surface to releasably retain the guide unit in the recess.

* * * * *